US007171969B2

(12) United States Patent
Gueret

(10) Patent No.: US 7,171,969 B2
(45) Date of Patent: Feb. 6, 2007

(54) BRUSH AND METHOD OF MAKING BRUSH

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 676 days.

(21) Appl. No.: 10/084,939

(22) Filed: Mar. 1, 2002

(65) Prior Publication Data

US 2002/0139385 A1 Oct. 3, 2002

(30) Foreign Application Priority Data

Mar. 1, 2001 (FR) ..... 01 02798

(51) Int. Cl.
*A45D 40/26* (2006.01)
*A46B 11/00* (2006.01)

(52) U.S. Cl. ..... 132/218; 401/129

(58) Field of Classification Search ..... 132/218, 132/317, 320, 318; 401/126, 122, 127, 129; 15/106

See application file for complete search history.

(56) References Cited

U.S. PATENT DOCUMENTS

| | | | |
|---|---|---|---|
| 565,328 | A | 8/1896 | Buhler |
| 1,659,707 | A | 2/1928 | Rudolph et al. |
| 1,806,520 | A | 5/1931 | Cave |
| 1,962,854 | A | 6/1934 | Anderson |
| 2,448,603 | A | 9/1948 | Kevin et al. |
| 3,033,213 | A | 5/1962 | Joss et al. |
| 3,214,782 | A | 11/1965 | Masters et al. |
| 3,469,928 | A | 9/1969 | Widegren |
| 3,908,675 | A | 9/1975 | Spatz et al. |
| 3,908,676 | A | 9/1975 | Levine et al. |
| 3,921,650 | A | 11/1975 | Montgomery |
| 4,365,642 | A | 12/1982 | Costa |

(Continued)

FOREIGN PATENT DOCUMENTS

| | | |
|---|---|---|
| DE | 42 05 935 | 9/1993 |

(Continued)

OTHER PUBLICATIONS

English Language Derwent Abstract of EP 1 020 136, Jul. 19, 2000.

(Continued)

*Primary Examiner*—John J. Wilson
*Assistant Examiner*—Robyn Doan
(74) *Attorney, Agent, or Firm*—Finnegan, Henderson, Farabow, Garrett & Dunner, LLP

(57) ABSTRACT

The invention relates to a brush that may include a core curved along at least a portion of its length so that an axis of the core defines a curve in a plane of curvature. A plurality of bristles are connected to the core. The bristles may define a cross-section of the brush that varies over at least a portion of the length of the core in a manner that is not geometrically similar. The cross-section of the brush at at least one position along the length of the core may be substantially asymmetric in relation to a plane perpendicular to the plane of curvature. The core may pass through the center of the cross-section of the brush at at least one location along the length of the core.

297 Claims, 11 Drawing Sheets

U.S. PATENT DOCUMENTS

| | | | | | |
|---|---|---|---|---|---|
| 4,403,624 | A | | 9/1983 | Montgomery | |
| 4,446,880 | A | * | 5/1984 | Gueret et al. | 132/218 |
| 4,458,701 | A | | 7/1984 | Holland | |
| 4,461,312 | A | * | 7/1984 | Gueret | 132/218 |
| 4,527,575 | A | | 7/1985 | Vasas | |
| 4,545,393 | A | | 10/1985 | Gueret et al. | |
| 4,561,456 | A | * | 12/1985 | Gueret | 132/218 |
| 4,586,520 | A | | 5/1986 | Brittain | |
| 4,617,948 | A | * | 10/1986 | Gueret | 132/218 |
| 4,635,659 | A | | 1/1987 | Spatz | |
| 4,662,385 | A | | 5/1987 | Schefer | |
| 4,784,505 | A | | 11/1988 | Dahm | |
| 4,804,004 | A | | 2/1989 | Taylor | |
| 4,810,122 | A | | 3/1989 | Cole | |
| 4,887,622 | A | | 12/1989 | Gueret | |
| 4,898,193 | A | | 2/1990 | Gueret | |
| 4,921,366 | A | | 5/1990 | Hurrell | |
| 4,927,281 | A | | 5/1990 | Gueret | |
| 4,993,440 | A | | 2/1991 | Gueret | |
| 5,094,254 | A | | 3/1992 | Krueckel et al. | |
| 5,137,038 | A | * | 8/1992 | Kingsford | 132/218 |
| 5,197,497 | A | | 3/1993 | Gueret | |
| 5,224,787 | A | | 7/1993 | Vasas | |
| 5,238,011 | A | | 8/1993 | Gueret | |
| 5,309,929 | A | | 5/1994 | Toll | |
| 5,339,841 | A | | 8/1994 | Gueret | |
| 5,345,644 | A | | 9/1994 | Gueret | |
| 5,357,987 | A | | 10/1994 | Schrepf | |
| 5,418,999 | A | * | 5/1995 | Smith | 15/106 |
| 5,482,059 | A | | 1/1996 | Miraglia | |
| 5,542,439 | A | | 8/1996 | Gueret | |
| 5,551,456 | A | | 9/1996 | Hartel | |
| 5,595,198 | A | | 1/1997 | Kemmerer | |
| 5,613,258 | A | | 3/1997 | Hilfinger et al. | |
| 5,709,230 | A | | 1/1998 | Miraglia | |
| 5,722,436 | A | | 3/1998 | Vandromme et al. | |
| 5,803,638 | A | | 9/1998 | Gueret | |
| 5,853,011 | A | * | 12/1998 | Gueret | 132/218 |
| 5,860,432 | A | | 1/1999 | Gueret | |
| 5,876,138 | A | | 3/1999 | Gueret | |
| 5,894,847 | A | | 4/1999 | Gueret | |
| 5,918,994 | A | | 7/1999 | Gueret | |
| 5,934,292 | A | | 8/1999 | Gueret | |
| 5,937,870 | A | | 8/1999 | Gueret | |
| 6,003,519 | A | | 12/1999 | Gueret | |
| 6,067,997 | A | | 5/2000 | Gueret | |
| 6,076,531 | A | | 6/2000 | Gueret | |
| 6,076,985 | A | | 6/2000 | Gueret | |
| 6,099,183 | A | | 8/2000 | Gueret | |
| 6,237,609 | B1 | * | 5/2001 | Vasas | 132/218 |
| 6,295,994 | B1 | * | 10/2001 | Thayer et al. | 132/218 |
| 6,345,923 | B2 | | 2/2002 | Gueret | |
| 6,450,177 | B1 | * | 9/2002 | Christoforu et al. | 132/218 |
| 6,532,967 | B1 | * | 3/2003 | Dumler | 132/218 |
| 2002/0020426 | A1 | | 2/2002 | Gueret | |

FOREIGN PATENT DOCUMENTS

| | | |
|---|---|---|
| EP | 0 511 842 | 11/1992 |
| EP | 0 663 161 | 7/1995 |
| EP | 1 020 136 | 7/2000 |
| FR | 726 157 | 5/1932 |
| FR | 2 285 101 | 4/1976 |
| FR | 2 505 633 | 11/1982 |
| FR | 2 605 505 | 4/1988 |
| FR | 2 678 494 | 1/1993 |
| FR | 2 701 198 | 8/1994 |
| FR | 2 715 038 | 7/1995 |
| FR | 2 730 910 | 8/1996 |
| FR | 2 730 911 | 8/1996 |
| FR | 2 745 272 | 8/1997 |
| FR | 2 749 489 | 12/1997 |
| FR | 2 749 490 | 12/1997 |
| FR | 2 755 593 | 5/1998 |
| FR | 2 798 267 | 3/2001 |
| FR | 2 811 525 | 1/2002 |
| GB | 1 335 322 | 10/1973 |
| GB | 2 146 520 | 4/1985 |
| GB | 2 170 996 | 8/1986 |
| GB | 2 174 895 | 11/1986 |
| JP | 56-91507 (U) | 12/1954 |
| JP | 58-88912 (U) | 6/1983 |
| JP | 63-111808 | 5/1988 |
| JP | 5-88410 (U) | 12/1993 |
| JP | 6-237818 | 8/1994 |
| JP | 8-33518 | 2/1996 |
| WO | WO 93/16617 | 9/1993 |
| WO | WO 96/29905 | 10/1996 |

OTHER PUBLICATIONS

Co-pending U.S. Appl. No. 09/761,701; Attorney Docket No. 05725.0675-00000 Title: Brush Having a Plano-Concave Profile Inventor(s): Jean-Louis H. Gueret U.S. Filing date: Jan. 18, 2001.

Co-pending U.S. Appl. No. 09/773,946; Attorney Docket No. 05725.0692-00000 Title: Brush Having Plano-Concave Profile Inventor(s): Jean-Louis H. Gueret U.S. Filing Date: Feb. 2, 2001.

Co-pending U.S. Appl. No. 09/867,646; Attorney Docket No. 05725.0707-00000 Title: Brush Having for Applying a Cosmetic Product and Make-up Device Comprising it Inventor(s): Jean-Louis H. Gueret U.S. Filing Date: May 31, 2001.

Co-pending U.S. Appl. No. 10/084,976; Attorney Docket No. 08048.0025-00000 Title: Applicator for Applying a Product to Keratinous Fibers Inventor(s): Jean-Louis H. Gueret U.S. Filing Date: Mar. 1, 2002.

Co-pending U.S. Appl. No. 10/084,975; Attorney Docket No. 08048.0026-00000 Title: Brush for Applying Product to Keratinous Fibers Inventor(s): Jean-Louis H. Gueret U.S. Filing Date: Mar. 1, 2002.

English language Derwent Abstract of DE 42 05 935, Sep. 2, 1993.

English language translation of FR 726 157.

English language Derwent Abstract of FR 2 285 101, Apr. 16, 1976.

English language Derwent Abstract of FR 2 678 494, Jan. 8, 1993.

English language Derwent Abstract of FR 2 798 267, Mar. 16, 2001.

* cited by examiner

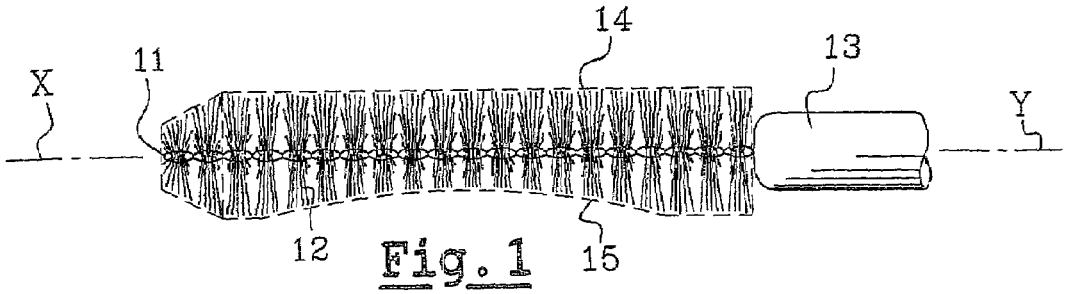
Fig. 1
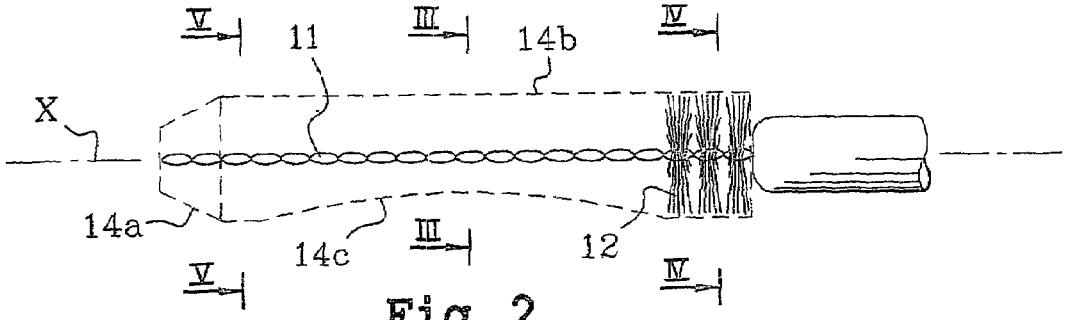
Fig. 2
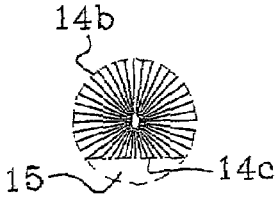
Fig. 3
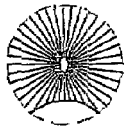
Fig. 3A
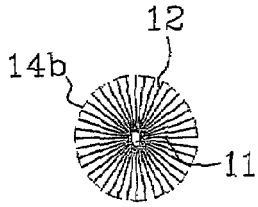
Fig. 4
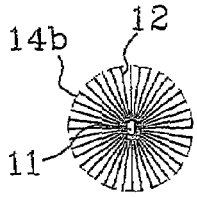
Fig. 5
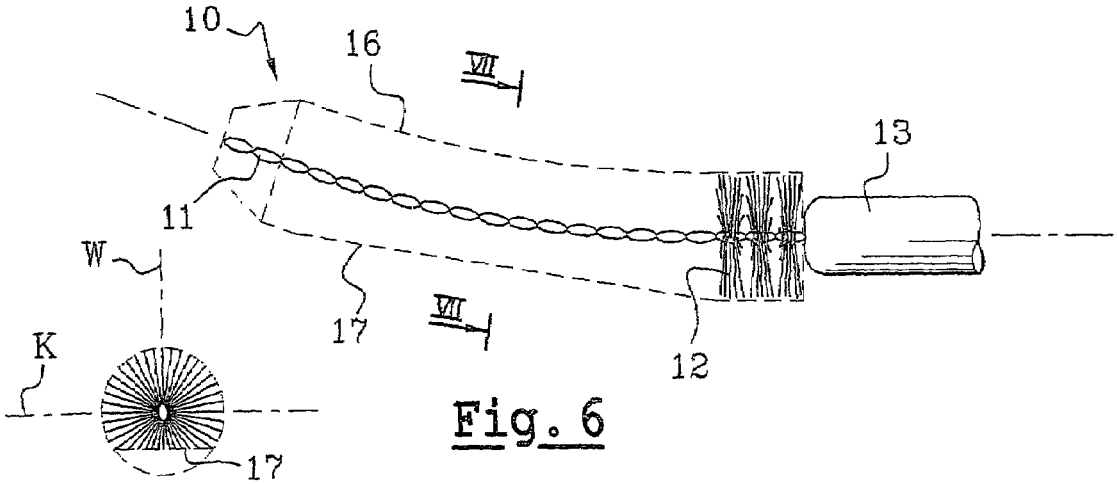
Fig. 6
Fig. 7

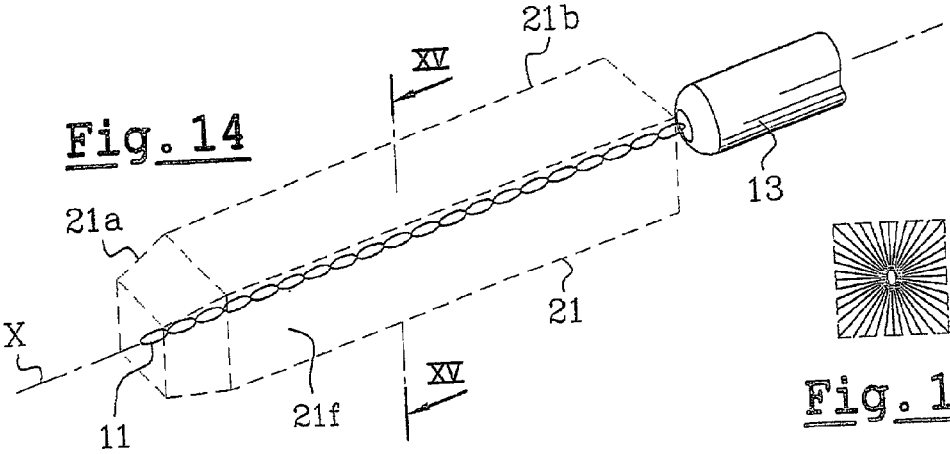
Fig. 14
Fig. 15
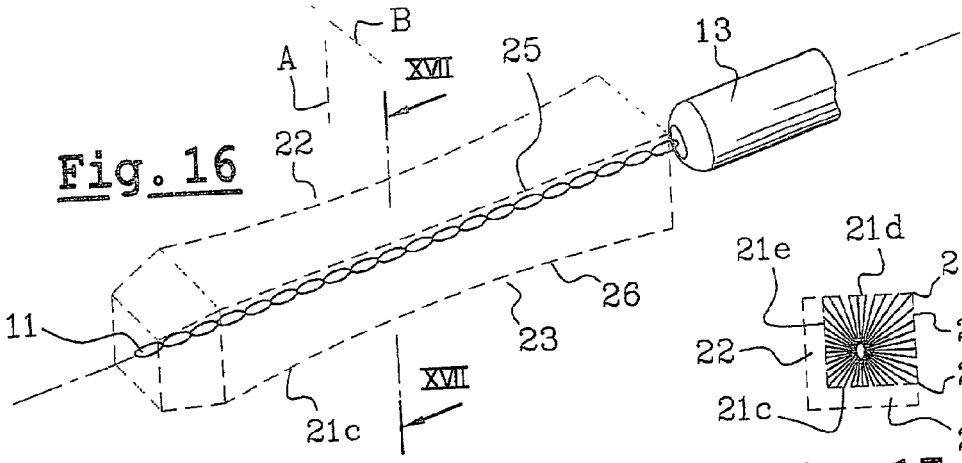
Fig. 16
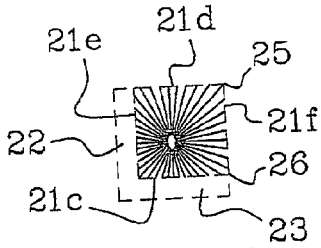
Fig. 17
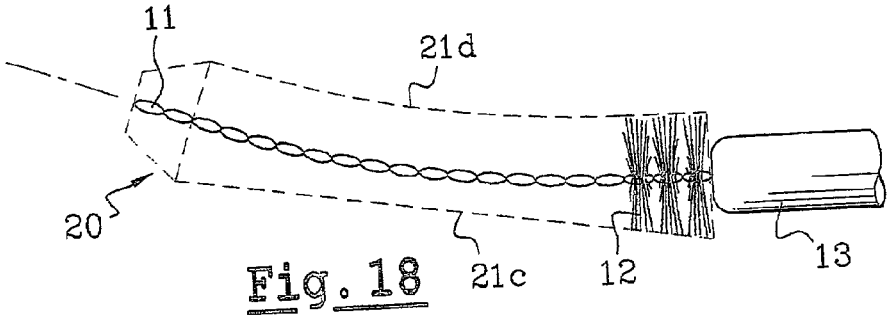
Fig. 18
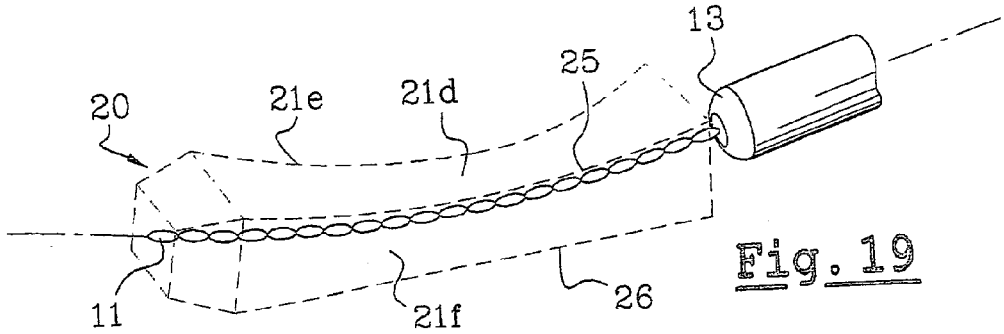
Fig. 19

BRUSH AND METHOD OF MAKING BRUSH

The present invention relates to a brush for applying a cosmetic and/or a care product to keratinous fibers, for example, applying mascara to eyelashes. The present invention also relates to a system for applying a product to keratinous fibers, a method of applying a product to eyelashes, and a method of manufacturing a brush.

Numerous brushes are known that comprise a rectilinear core formed by two twisted-together strands of metal wire holding tufts of bristles between them. Brushes are also known in which the core is curved about an axis. For example, German patent application DE A 4 205 935 describes a brush having a core bent at an angle, wherein bristles of the brush define a cross-section that is circular. In such known curved-core brushes, bristles define a cross-section of the brush that remains substantially constant along the length of the core.

There exists a need for a brush that provides improved quality of makeup, ease-of-use, improved product loading, as well as improved elongation, curving, separation, and penetration of the application members amongst the eyelashes.

There exists a need for an applicator that provides improved quality of the makeup, ease of use, improved product loading, as well as improved elongation, curving, and bristle penetration of eyelashes.

In the following description, certain aspects will become evident. It should be understood that the invention, in its broadest sense, could be practiced without having one or more of these aspects.

In accordance with the purpose of the invention, as embodied and broadly described herein, the invention includes a brush including a core curved along at least a portion of its length so that an axis of the core defines a curve in a plane of curvature, and a plurality of bristles connected to the core. The bristles may define a cross-section of the brush that varies over at least a portion of the length of the core in a manner that is not geometrically similar. The cross-section of the brush at at least one position along the length of the core may be substantially asymmetric in relation to a plane perpendicular to the plane of curvature. The core may pass through the center of the cross-section of the brush at at least one location along the length of the core.

As used herein, the term "cross-section" relates to a cross-section taken in a plane perpendicular to the axis of the core.

As used herein, the term "plane of curvature" means a plane that is perpendicular to an axis about which the core of a blank is curved and that contains at least the curved portion of the axis of the core. When a core is curved about two or more axes not parallel to one another, the core will have multiple planes of curvature.

As used herein, cross-sections that are "not geometrically similar" satisfy at least one of the following two conditions: 1) the cross-sections have shapes differing from one another in other than scale magnitude (e.g., one cross-section is not a scale magnification or scale demagnification of another cross-section; the cross-sections may be shaped analogous to non-homothetic figures); and 2) the cross-sections have differing ratios of a to b, wherein a is the longest distance from the axis of the core to the outer boundary of the cross-section and b is the shortest distance from the axis of the core to the outer boundary of the cross-section. When the axis of the core is located at the center of a circular shaped cross-section, the ratio of a to b is one.

Some exemplary embodiments of the brush may render it possible to obtain makeup quality that is highly satisfactory because the brush may present faces having different shapes which, when combined with a curved core, make it possible when the brush is rotated about the axis of a stem, to manage the eyelashes in an improved manner. The shape of the brush may also make it possible to obtain non-uniform wiping upon removal from a brush receptacle, thus leading to zones that may be unevenly filled with substance.

The envelope surface defined by the free ends of the bristles of the brush, if the core is straightened out and made rectilinear for observation purposes, may not be circularly symmetric. In other words, when one straightens the core of a brush in accordance with one exemplary embodiment of the invention (e.g., straightening the core of a curved core brush so that a blank results), the envelope surface defined by the free ends of the bristles may not be circularly symmetric.

As used herein, the term "circularly symmetric" relates to a configuration having a circular shaped cross-section, wherein the axis of the core passes through the center of the circular shaped cross-section.

As used herein, the term "envelope surface" refers to an imaginary surface defined by ends of at least some of the bristles connected to the core (of the brush or the blank). For example, the envelope surface could be considered to be the three-dimensional image seemingly formed by the bristle ends when the brush/blank is viewed by an observer. When there are a mixture of shorter bristles and longer bristles extending in substantially the same direction at substantially the same axial position on the core, the ends of the longer bristles may define the envelope surface, while the ends of the shorter bristles may be beneath that surface.

In yet another aspect, a brush may be provided including a core curved along at least a portion of its length so that an axis of the core defines a curve in a plane of curvature. The curve may have a convex side and a concave side. The brush may further include a plurality of bristles connected to the core. The bristles may comprise ends defining an envelope surface of the brush and may define a cross-section of the brush that varies over at least a portion of the length of the core in a manner that is not geometrically similar. The cross-section of the brush at at least one position along the length of the core may be substantially asymmetric in relation to a plane perpendicular to the plane of curvature. In the plane of curvature, the distance from the convex side of the curve to the envelope surface may vary along at least a portion of the length of the core.

In another aspect, a brush including a core curved along at least a portion of its length so that an axis of the core defines a curve in a plane of curvature may be provided. The brush may further include a plurality of bristles connected to the core, with the bristles defining a cross-section of the brush that may vary over at least a portion of the length of the core in a manner that is not geometrically similar. The cross-section of the brush at at least one position along the length of the core may be substantially asymmetric in relation to a plane perpendicular to the plane of curvature. When the core is straightened, ends of the bristles may define at least one notch having a maximum width located between ends of the notch spaced apart from one another along the length of the brush.

According to yet another aspect, a brush may include a core curved along at least a portion of its length so that an axis of the core defines a curve in a plane of curvature and a plurality of bristles connected to the core. The bristles may define a cross-section of the brush that varies over at least a portion of the length of the core in a manner that is not geometrically similar. The cross-section of the brush at at least one position along the length of the core may be substantially asymmetric in relation to a plane perpendicular to the plane of curvature. When the core is straightened, ends of the bristles may define at least one notch, with the notch being concave in at least one plane intersecting the notch.

In still another aspect, the a brush may include a core curved along at least a portion of its length so that an axis of the core defines a curve in a plane of curvature. The core may have a convex side and a concave side, and a plurality of bristles connected to the core. The bristles may include ends that define an envelope surface of the brush and that define a cross-section of the brush that may vary over at least a portion of the length of the core in a manner that is not geometrically similar. The cross-section of the brush at at least one position along the length of the core may be substantially asymmetric in relation to a plane perpendicular to the plane of curvature. The envelope surface on the convex side of the curve may define a substantially planar surface along at least a portion of the length of the brush, with the substantially planar surface intersecting the plane of curvature.

In a further aspect, a brush may include a core curved along at least a portion of its length so that an axis of the core defines a curve in a plane of curvature. The curve may have a convex side and a concave side. The brush may also include a plurality of bristles connected to the core. The bristles may include ends defining an envelope surface of the brush and a cross-section of the brush that varies over at least a portion of the length of the core in a manner that is not geometrically similar. The cross-section of the brush at at least one position along the length of the core may be substantially asymmetric in relation to a plane perpendicular to the plane of curvature. In the plane of curvature, the envelope surface on the convex side of the curve may define a substantially rectilinear edge along at least a portion of the length of the brush.

In an additional aspect, a brush may include a core curved along at least a portion of its length so that an axis of the core defines a curve in a plane of curvature and a plurality of bristles connected to the core. The bristles may define a cross-section of the brush that varies over at least a portion of the length of the core in a manner that is not geometrically similar. The cross-section of the brush at at least one position along the length of the core may be substantially asymmetric in relation to a plane perpendicular to the plane of curvature. The brush may further include a stem having an end portion connected to the core that defines an axis. The brush may have a free end being not aligned with the axis of the end portion of the stem.

In still another aspect, a brush may be provided which includes a core curved along at least a portion of its length so that an axis of the core defines a curve in a plane of curvature, and a plurality of bristles connected to the core. The bristles define a cross-section of the brush that may vary over at least a portion of the length of the core in a manner that is not geometrically similar. The cross-section of the brush at at least one position along the length of the core may be substantially asymmetric in relation to a plane perpendicular to the plane of curvature. Along at least a portion of the length of the brush, the cross-section of the brush may have a varying width dimension. The width dimension may pass through the core and may be perpendicular to the plane of curvature.

In one aspect, the brush may include at least three side faces having shapes differing from one another. Such a brush may make it possible to increase the number of effects exerted by the bristles on the eyelashes (e.g., the action of a face of the brush of a given shape being different from the action of a face of different shape).

In yet another aspect, when the core is straightened, the bristles may define a portion (e.g., a cylindrical or a frustoconical portion) generally on the same axis as the core and may be provided with at least one notch defining a maximum width between ends of the notch. As a result, over at least a portion of its length, the brush may present a cross-section that varies in a manner that is not geometrically similar due, at least in part, to the presence of the notch, for example.

In a further aspect, when the core is straightened, the bristles may define a notch. The notch may be concave in a direction substantially perpendicular to the core. Such a notch may be partially cylindrical (e.g., having an axis perpendicular or parallel to the axis of the straightened core). In certain cross-sections passing through the notch (and/or in certain places parallel to the core and intersecting the notch), the notch may appear as a portion of a circle, a portion of an ellipse, or any other curved line. The term "curved" as used herein could relate to any "non-rectilinear" shape, such that a line bent at an angle constitutes a curved line. According to one aspect, the notch may be concave.

In still another aspect, when the core is straightened, the bristles may define an odd number of notches (e.g., three, five, or seven).

According to yet another aspect, when the core is straightened, the bristles may define at least four side faces. Two of the four side faces may be substantially planar while two of the four side faces may not be substantially planar. The two substantially planar side faces may be adjacent to one another and the two side faces that are not substantially planar may be adjacent to one another.

According to an additional aspect, the bristles may define at least one cross-section that is substantially rectangular, and wherein, when the core is straightened, the bristles define two adjacent substantially planar faces and two adjacent concave faces.

In yet another aspect, when the core is straightened, the bristles define a general peanut shape having at least one flat side (e.g., with at least three substantially planar facets placed in a triangular configuration about the axis of the core). In a brush made from such a blank/brush, at least one of the facets may be rendered non-planar via, for example, curving the core.

In another aspect, the core may be located off-center in the cross-section of the brush over at least a portion of the length of the brush. In other words, the core passes through a point other than the center of the cross-section of the brush at at least one location along the length of the core. A stem may be connected to the core. The at least one location along the length of the core where the core passes through the center of the cross-section of the brush may be located adjacent the stem and/or at a free end of the core.

According to still another aspect, the brush may be made from a blank having a general shape chosen from a substantially bullet shape, a substantially peanut shape, a substantially buoy shape, a substantially fish shape, a substantially hourglass shape, and a substantially football shape.

In another aspect, the bristles may define a cross-section having at least one of a maximum cross-sectional area and a minimum cross-sectional area located between two axial ends of the brush. For example, the brush may be made from a blank that is generally circularly symmetrical and of cross-section whose diameter passes through a maximum in a first half of the length of the brush starting from its free end and through a minimum in the second half of the length of the brush (e.g., when the blank is generally fish-shaped).

In yet another aspect, the cross-section may include peripheral steps over at least a portion of the length of the core.

According to a further aspect, the core may include a twisted wire core having one of a left-hand pitch and a right-hand pitch (e.g., a core having a left-hand pitch is described in French patent application FR-A-2 701 198). In a left-hand pitch brush, the strands of the core may be twisted by being turned to the left so as to form turns which, when viewed along the axis of the core from an end fixed in a stem, turn clockwise on traveling away from the stem towards the free end of the brush. When the core has a left-hand pitch, the core may be advantageously curved in such a manner as to reduce the inclination of helical sheets formed by the bristles relative to an axis of the stem on going progressively further from the stem. This may result in improved separation between eyelashes at the ends of an eyelid by increasing the angle between the eyelashes and the helical sheets. On the other hand, when the brush has a right-hand pitch, the curvature of the core may also make it possible to modify the orientation of the helical sheets of bristles so as to obtain a desired result for makeup purposes.

The core may be formed of structures other than metal wires twisted together. For example, the bristles may be implanted or molded onto a core lacking twisted wires. The bristles may be natural or synthetic, and their ends may be subjected to any known type of treatment (e.g., for the purpose of forming rounded tips or forked ends on the bristles).

According to another aspect, the bristles may have differing lengths. For example, longer bristles may define an envelope surface defining a volume containing shorter bristles. It is possible to use a mixture of bristles, and to use bristles of all kinds, including, but not limited to, hollow bristles, bristles having a capillary groove, bristles having preferred deformation zones, bristles having a corkscrew-shape, and/or bristles having a flat shape.

In another aspect, the axis of the brush may be angled adjacent to the stem. In addition, the core may be given an angle in the vicinity of a core portion that is implanted in the stem. For example, in one aspect, the angle between the axis of the stem and the axis of the portion of the core supporting the bristles at any point of the core is always less than 90°.

The invention is not limited to a brush whose core is curved about a single axis. For example, the core can be curved about at least two axes that are not mutually parallel. Under such circumstances, the axis of the core may be curved so that it is not entirely contained in any single plane. For example, the axes about which the core is curved may extend in directions that are perpendicular (e.g., axes that optionally intersect).

In one exemplary embodiment where the end of the brush remote from the stem is off-center relative to the axis of the stem, when the brush passes through a relatively rigid wiper that matches the diameter of the stem, the brush may flex as it passes through the wiper, and as soon as it has gone past the wiper it may return to its initial configuration by moving transversely, which can have the effect of shearing through any drop of product that might be present at the end of the brush. This may reduce the risk of such a drop of product being present at the free end of the brush, where such a drop may present difficulties during application.

The core of the brush may present curvature that is not constant (e.g., a portion that is rectilinear or substantially rectilinear and a portion that is curved).

In another additional optional aspect of the invention, a system may include a brush along with a reservoir configured to contain a product to be applied by the brush. For example, the product contained in the reservoir may be a hair product (e.g., mascara).

In another optional aspect, the system may further include a wiper associated with the reservoir. In yet an additional aspect, the brush, may include a cap configured to close the reservoir.

Such a system may include, for example, a receptacle containing a supply of product (e.g., mascara), and an applicator. The applicator may be provided at one end with a handle member (e.g., a cap interconnected to the core via a stem), and at the other end, a brush according to any optional aspects of the invention. The applicator may be fastenable in a leaktight manner to the receptacle (e.g., when the cap is screwed onto the receptacle). The brush may be capable of dipping into the product (e.g., a liquid substance) contained inside the receptacle, and the receptacle may also be provided with a wiper.

In another additional aspect, a method of applying product to keratinous fibers includes providing a brush according to the invention, loading the brush with product, and applying the product to keratinous fibers with the brush. In an additional aspect, the keratinous fibers may be eyelashes.

The term "providing" is used in a broad sense, and refers to, but is not limited to, making available for use, enabling usage, giving, supplying, making, obtaining, getting a hold of, acquiring, purchasing, selling, distributing, possessing, making ready for use, and/or placing in a position ready for use.

According to still another aspect of the invention, a method of manufacturing a brush includes providing a blank comprising a core, and a plurality of bristles connected to the core. The bristles may define a cross-section of the blank that varies over at least a portion of the length of the core in a manner that is not geometrically similar. The bristles may further define at least one face having a non-planar shape. The method further may include curving the core along at least a portion of its length so that an axis of the core defines a curve in a plane of curvature. The curving may cause the at least one face to become substantially planar shaped. The blank may be transformed into a brush and the cross-section of the brush at at least one position along the length of the core may be substantially asymmetric in relation to a plane perpendicular to the plane of curvature.

According to yet another aspect, the blank may include at least one additional face having a substantially planar shape, and the curving may cause the at least one additional face to become non-planar, substantially convex shaped, or substantially concave shaped.

In yet another aspect, the at least one face of the blank may have a substantially concave shape or a substantially convex shape.

In another aspect, the curving may include curving the core in a plane of curvature perpendicular to the at least one face of the blank.

According to an additional aspect, the blank may further include at least one additional face having a substantially convex shape, wherein the curving may cause the at least one additional face to become substantially convex shaped. In another aspect, the at least one additional face may have a substantially convex shape, wherein the curving may cause the at least one additional face to become substantially concave shaped.

In an additional aspect, the plane of curvature may define a plane of symmetry for the at least one face.

In a further aspect, the bristles of the blank may include ends defining an envelope surface having a general shape chosen from a substantially cylindrical shape having a substantially circular cross-section, a substantially peanut shape, a substantially buoy shape, and a substantially fish shape.

In still another aspect of the method, the core may be a twisted wire core having, for example, a left-hand pitch.

In another aspect, the core of the brush may be configured so that the core passes through the center of the cross-section of the brush at at least one location along the length of the core.

In a further aspect, the curve may have a convex side and a concave side, wherein the bristles may include ends defining an envelope surface, and wherein, in the plane of curvature, the distance from the convex side of the curve to the envelope surface may vary along at least a portion of the length of the core.

In still another aspect, the blank may include bristle ends defining at least one notch having a maximum width located between ends of the notch spaced apart from one another along the length of the blank.

According to an additional aspect of the invention, the bristles of the blank may include bristle ends defining at least one notch, the notch being concave in at least one plane intersecting the notch.

In another aspect, the curve may have a convex side and a concave side, wherein the bristles include ends defining an envelope surface, and wherein the envelope surface on the convex side of the curve defines a substantially planar surface along at least a portion of the length of the brush, the substantially planar surface intersecting the plane of curvature.

According to yet another aspect, the curve may have a convex side and a concave side, wherein the bristles include ends defining an envelope surface, and wherein, in the plane of curvature, the envelope surface on the convex side of the curve defines a substantially rectilinear edge along at least a portion of the length of the brush.

In another aspect, the brush may include a stem having an end portion connected to the core. The end portion of the stem may define an axis. And the brush may have a free end being not aligned with the axis of the end portion of the stem.

In an additional aspect, the brush may be configured so that along at least a portion of the length of the brush, the cross-section of the brush has a varying width dimension, the width dimension passing through the core and being perpendicular to the plane of curvature.

In another aspect, the core of the blank may be substantially rectilinear.

According to an additional aspect of the method, the blank may include a stem connected to the core. The method may further include connecting a stem to the core.

An additional aspect includes a brush manufactured according to any of the methods described herein.

In one aspect, the blank may include at least one edge having a substantially rectilinear shape, and the curving causes the at least one edge to become non-rectilinear shaped. The curving may cause the at least one edge to become substantially convex shaped or substantially concave shaped.

In an additional aspect, the blank may include at least one non-rectilinear edge, and the curving causes the at least one non-rectilinear edge to become substantially rectilinear. The at least one non-rectilinear edge of the blank may have a substantially concave shape or a substantially convex shape.

In another aspect, the at least one face may extend partially along the length of the core.

In another optional aspect of the invention, a method of manufacturing a brush may include providing a blank including a core, and a plurality of bristles connected to the core. The bristles may define a cross-section of the blank that varies over at least a portion of the length of the core in a manner that is not geometrically similar. The blank may further include at least one edge having a non-rectilinear shape. The method may further include curving the core along at least a portion of its length so that an axis of the core defines a curve in a plane of curvature. The curving may cause the at least one edge to become substantially rectilinear shaped, and the blank may be transformed into a brush. And the cross-section of the brush at at least one position along the length of the core may be substantially asymmetric in relation to a plane perpendicular to the plane of curvature.

In another aspect of the method, the plane of curvature may contain the at least one edge.

In still another aspect, the blank may include at least one face having a substantially planar shape and the curving may cause the at least one face to become nonplanar (e.g., substantially convex shaped or substantially concave shaped).

In another aspect, the blank may further include at least one additional edge having a substantially concave shape, and the curving may cause the at least one additional edge to become substantially convex shaped.

According to an additional aspect, the blank may further include at least one additional edge having a substantially convex shape, and the curving may cause the at least one additional edge to become substantially concave shaped.

In still another aspect, the blank may include at least one additional edge having a substantially rectilinear shape, and the curving may cause the at least one edge to become non-rectilinear shaped (e.g., convex shaped or concave shaped).

In another aspect, the at least one edge may extend partially along the length of the core.

Aside from the structural and procedural arrangements set forth above, the invention could include a number of other arrangements, such as those explained hereinafter. It is to be understood, that both the foregoing description and the following description are exemplary.

The accompanying drawings are incorporated in and constitute a part of this specification. The drawings illustrate exemplary embodiments of the invention and, together with the description, serve to explain some principles of the invention. In the drawings, FIG. 1 is a schematic side view of an embodiment of a blank from which an exemplary embodiment of a brush can be made;

FIG. 2 is a view of the blank embodiment shown in FIG. 1, with only a portion of the bristles being shown;

FIG. 3 is a cross-section view taken along line III—III of FIG. 2;

FIG. 3A is a cross-sectional view similar to FIG. 3 of another blank embodiment;

FIG. 4 is a cross-section view taken along line IV—IV of FIG. 2;

FIG. 5 is a cross-section view taken along line V—V of FIG. 2;

FIG. 6 is a side view of another embodiment of a brush;

FIG. 7 is a cross-section view taken along line VII—VII of FIG. 6;

FIG. 14 is a schematic perspective view of a blank from which another embodiment of a brush can be made;

FIG. 15 is a cross-section view taken along line XV—XV of FIG. 14;

FIG. 16 is schematic perspective view of a blank like that of FIG. 14 from which another embodiment of a brush can be made;

FIG. 17 is a cross-section view taken along line XVII—XVII of FIG. 16;

FIG. 18 is a side view of another embodiment of a brush;

FIG. 19 is a perspective view of the embodiment shown in FIG. 18;

Reference will now be made in detail to some possible embodiments of the invention, examples of which are illustrated in the accompanying drawings. Wherever possible, the same reference numbers are used in the drawings and the description to refer to the same or like parts.

Figure 8:
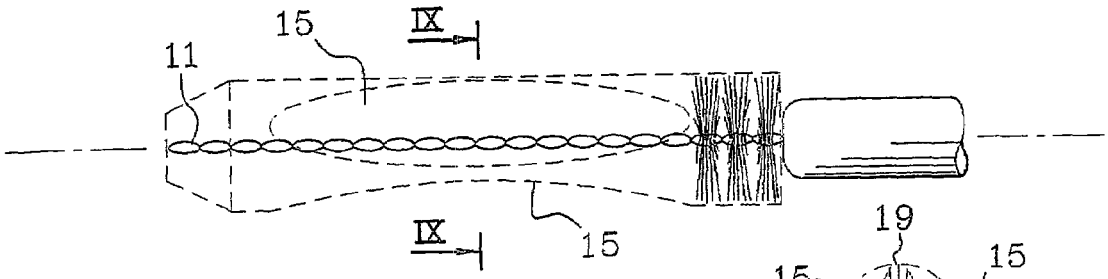
FIG. 8 is a schematic side view of a blank from which another embodiment of a brush can be made.

A first exemplary implementation of the invention is described below with reference to FIGS. 1 through 7.

FIG. 6 shows a brush 10 in accordance with an optional aspect of the invention for applying, for example, mascara to eyelashes. The brush may include a core 11 constituted by two twisted-together strands of metal wire with tufts of bristles 12 held between the turns of the core 11, for example, in conventional manner. The core 11 may be fixed to one end of a stem 13. Stem 13 may be made of plastic material, for example, and the core 11 may be inserted therein as a force-fit.

According to an exemplary aspect of the invention, to make the brush 10, a cylindrical blank may be used as shown in FIG. 1, having a core 11 that is rectilinear and that extends along an axis X that may optionally coincide with the axis Y of the stem 13. A notch 15 may be formed in the blank. The free ends of the bristles define an envelope surface 14. As can be seen in FIG. 2, this envelope surface 14 may include a frustoconical end portion 14*a* and a main portion 14*b* which may be circularly cylindrical with the exception of the bottom 14*c* of the notch 15. The bottom 14*c* of the notch 15 may constitute a partially cylindrical surface about an axis that is perpendicular to the plane of FIG. 2.

In an exemplary variant such as the one shown in FIG. 3A, the bottom 14*c* of the notch may have a cross-section in the form of a portion of a circle, with the notch 15 being concave both about an axis perpendicular to the plane of FIG. 2 and about an axis parallel to the axis X of the core 11.

In an exemplary method, to make the brush 10 from the blank of FIGS. 1 and 2, the core 11 may be curved about an axis of curvature perpendicular to the plane of FIG. 2. The axis of curvature may be situated on the side opposite from the notch 15 so as to have the effect of flattening the notch out to such an extent as to transform it into a substantially planar facet 17 (i.e., planar surface). Forming such a facet 17 in place of the notch 15 also has the effect of forming on the side opposite from the notch 15 a portion of an envelope surface 16 that becomes outwardly concave. As shown in FIG. 6, which is taken along the plane of curvature of the curve defined by the axis of the core 11, the brush 10 has a free end out of alignment with an axis of the portion of stem 13 connected to core 11.

On examining FIG. 7, it will be observed that over the portion of the core 11 along which the initial notch 15 was made, the brush may present a cross-section that is asymmetric about a plane K that is perpendicular to the plane of curvature W of the core 11 and containing the axis of the core 11.

In the example described above, the blank shown in FIGS. 1 and 2 has only one notch 15. It is possible, however, to start from a blank that has three notches disposed (e.g., symmetrically) about the axis X of the blank, as shown in FIGS. 8 and 9, thus giving a brush whose cross-section is generally triangular, for example, over a fraction of its length.

Figure 9:
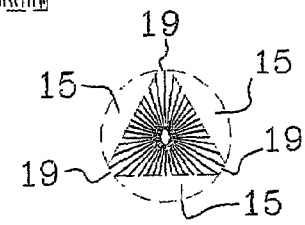
FIG. 9 is a cross-section view taken along line IX—IX of FIG. 8.

Starting from the blank of FIG. 8, it may be possible to make a brush by imparting curvature to the core 11 in the same manner as for converting the blank of FIG. 2 into the brush of FIG. 6. The resulting brush then presents a substantially planar facet where one of the notches 15 used to be.

The plane of curvature of the core of the FIG. 6 brush is parallel to the plane of FIG. 2 and contains the axis X. This plane of curvature constitutes a midplane of symmetry for the facet 17, being substantially perpendicular thereto. It should be observed that by having an odd number of facets 17, one of the ridge lines 19 (e.g., edges) formed between two adjacent notches 15 of the FIG. 8 brush may be contained in the plane of curvature of the core 11, with the notch 15 opposite said ridge line 19 being straightened out by the curvature imparted to the core 11.

Figure 10:
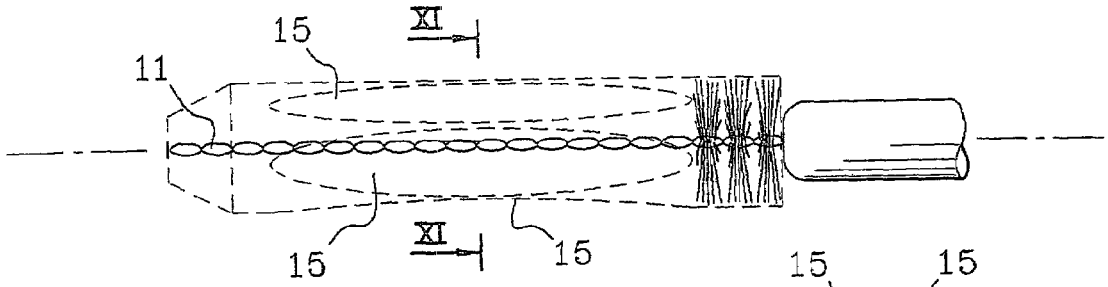
FIG. 10 is a schematic side view of a blank from which another embodiment of a brush can be made.
Figure 11:
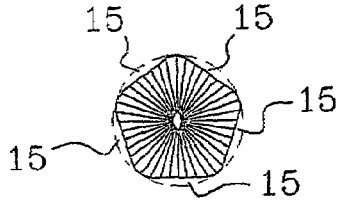
FIG. 11 is a cross-section view taken along line XI—XI of FIG. 10.
Figure 12:
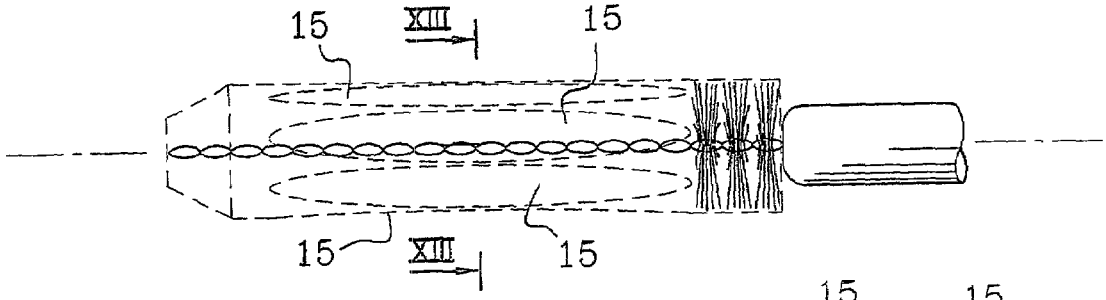
FIG. 12 is a schematic side view of a blank from which another embodiment of a brush can be made.
Figure 13:
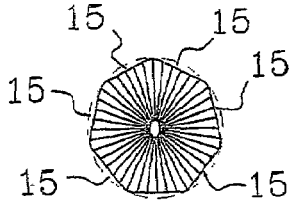
FIG. 13 is a cross-section view taken along line XIII—XIII of FIG. 12.

FIG. 10 shows a blank having five notches 15, and FIG. 12 shows a blank having seven notches 15. Brushes may be obtained from these blanks by imparting curvature to their cores 11 in a manner analogous to that described above with reference to FIGS. 1 through 9.

Another exemplary embodiment of brush 20 constituting another implementation of the invention is described below with reference to FIGS. 14 through 19, with the finished brush 20 shown in FIGS. 18 and 19.

To make brush 20, the blank shown in FIG. 14 may be used. The blank may be provided with an envelope surface 21 formed by combining a main portion 21 b of square section rectangular shape with an end portion 21*a* in the form of a truncated pyramid. As shown in FIG. 15, the blank may include at at least one point, a cross-section centered on the core 11 (i.e., the core 11 may be located at the barycenter of the cross-section). As shown in FIGS. 16 and 17, notches 22 and 23 may be formed to result in a cross-section that varies such that cross-sections at differing locations along the core 11 are not geometrically similar. In FIG. 17, the core 11, as bounded by edges 21*c*–21*f*, is off-centered with respect to the core 11 (i.e., the core 11 is not at the location of the barycenter of the cross-section). In FIG. 15, the barycenter of the cross-section is located at the core 11.

As shown in FIG. 16, the notches 22 and 23 are concave and formed on the blank in two adjacent faces. Notches 22 and 23 extend, for example, over the full length of the main portion 21*b* of the envelope surface 21. The respective bottoms 21*e* and 21*c* of notches 22 and 23 may constitute portions of cylindrical surfaces prior to the core 11 being deformed (e.g., while the core 11 is still rectilinear). Thereafter, a certain amount of curvature may be imparted to the core 11 so as to substantially flatten out the notch 23 (e.g., by bending the core 11 about an axis B). The bottom 21*c* of the notch 23 may then become substantially planar while the initially planar opposite face 21*d* may become substantially outwardly concave. The bottom 21 *e* of the notch 22 may thus be curved both about an axis A parallel to the plane of curvature of the core 11 and about the axis B. As shown in FIG. 16, the face 21*f* of the brush opposite to the notch 22, may be defined by two edges 25 and 26, which may be substantially rectilinear, parallel to the axis X, and curved (e.g., outwardly concave).

Because of the curvature given to the core 11, the edge 25 becomes curved in the brush of FIG. 18 and the edge 26 becomes substantially rectilinear. The resulting brush 20 may apply (e.g., makeup) in a very high quality manner because of the curvature of the core 11 and because of the different shapes of its faces which follow one another in contact with, for example, eyelashes when the brush is turned about the axis of the stem 13 while applying make up.

Figure 20:
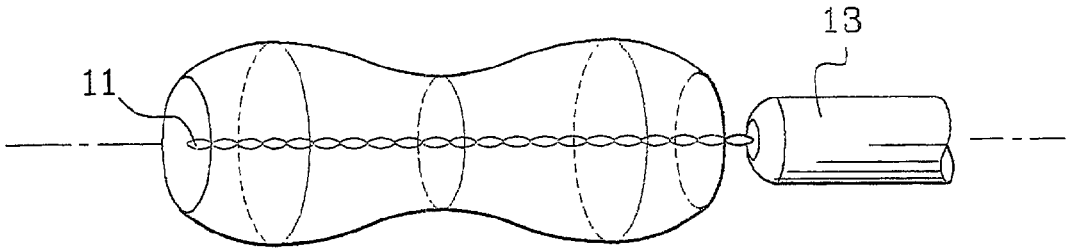
FIG. 20 is a schematic perspective view of a blank from which another embodiment of a brush can be made.
Figure 21:
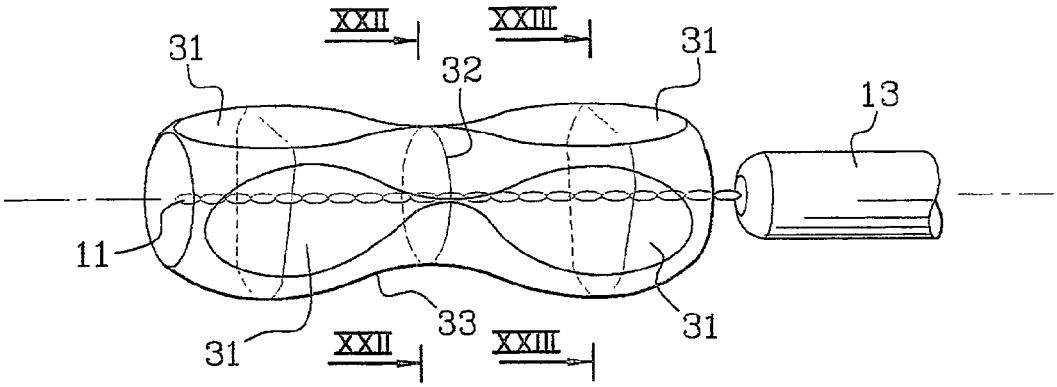
FIG. 21 is a perspective view of a blank obtained from the blank of FIG. 20 following manufacturing.
Figure 22:
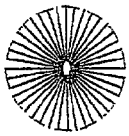
FIG. 22 is a cross-section view taken along line XXII—XXII of FIG. 21.
Figure 23:
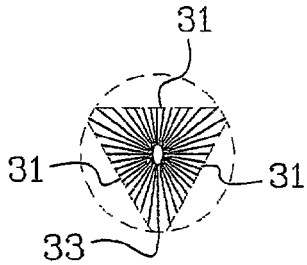
FIG. 23 is a cross-section view taken along line XXIII—XXIII of FIG. 21.
Figure 24:
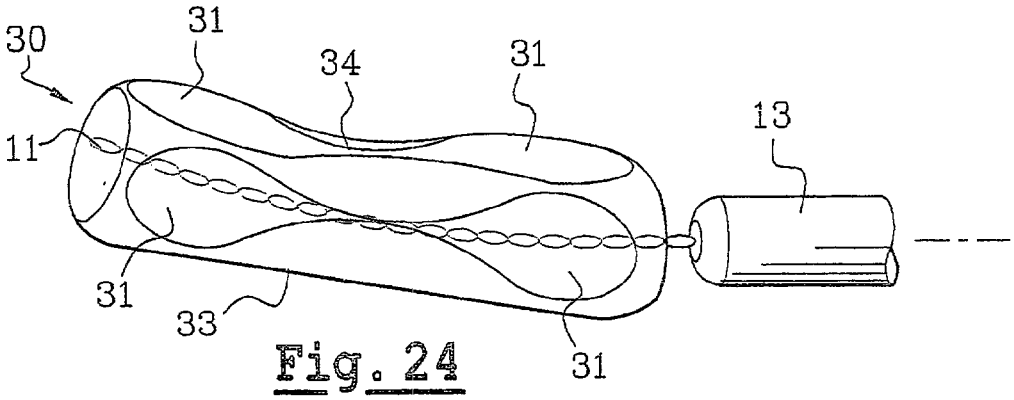
FIG. 24 is a schematic perspective view of another embodiment of a brush formed from the blank of FIG. 21.

FIG. 24 shows a brush 30 that is obtained from a blank as shown in FIG. 20. This blank is generally peanut-shaped. As shown in FIGS. 21 and 23, substantially planar facets 31 parallel to the axis X of the core may be formed in the blank (e.g., by machining the blank). These facets 31 may be formed on three side faces of the blank so that in cross-section, the brush presents a generally triangular shape (see, e.g., FIG. 23) with ridge zones 33 (i.e., edges) being formed between the facets 31.

In the example described, the facets 31 have all been formed at a distance from the core 11 which corresponds substantially to the radius of the smallest diameter circle 32 situated between the two swollen portions of the blank. It would not go beyond the ambit of the present invention, however, for the facets 31 to be formed at different distances from the core 11 (i.e., with a set of facets situated on one side of the blank being formed at a distance from the core 11 that is different from the distance at which another set of facets situated on another side of the core 11 is formed). The facets 31 may also be formed at a distance from the core that is shorter than the radius of the small diameter circle 32 or that is greater than said distance.

The brush of FIG. 24 may be made from the blank shown in FIG. 21 by imparting curvature to the core 11 in such a manner as to cause the ridge zone 33 which corresponds to the bottom edge of the brush shown in FIG. 21 to become substantially rectilinear. The curvature imparted to the core 11 may have the effect of modifying the shape of the side face of the brush which is diametrically opposite from its bottom edge 33. Thus, the two top facets 31 of the blank in FIG. 21 are connected together in the brush of FIG. 24 by a zone 34 that is outwardly concave (i.e., no longer substantially rectilinear).

Figure 25:
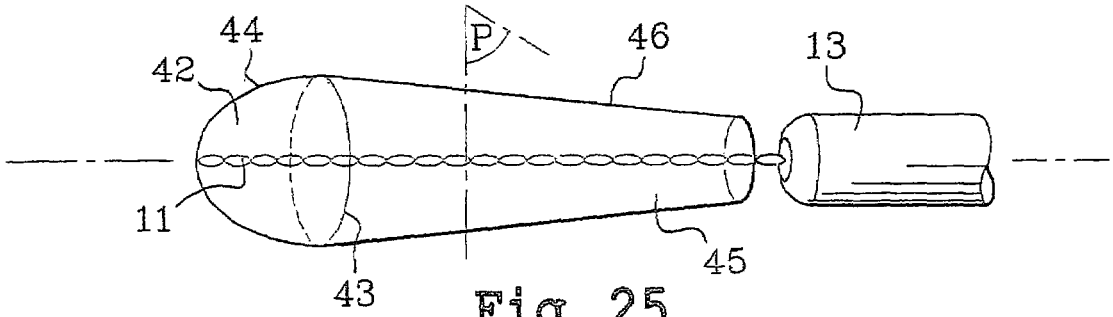
FIG. 25 is a perspective view of an embodiment of a blank according to an aspect of the invention.
Figure 26:
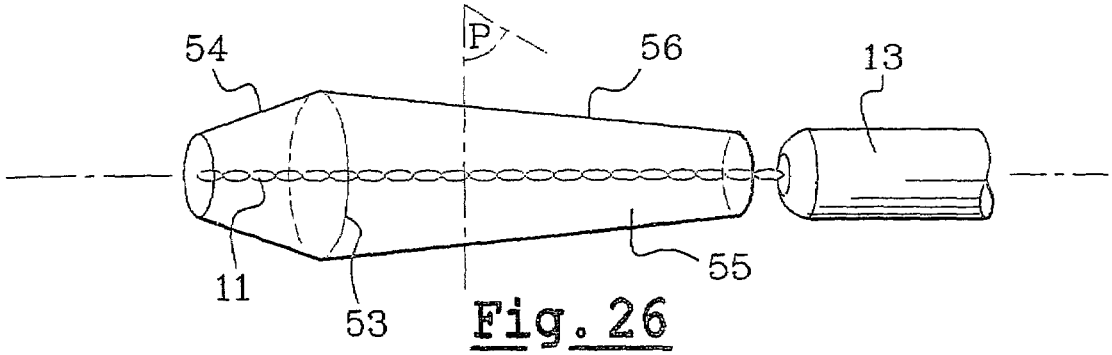
FIG. 26 is a perspective view of another embodiment of a blank.
Figure 27:
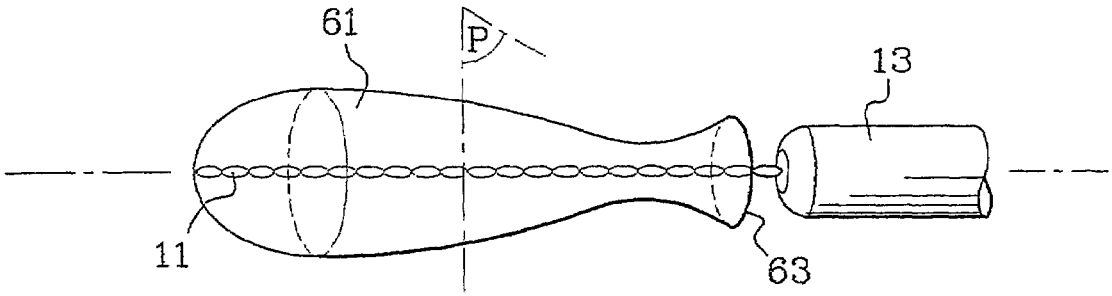
FIG. 27 is a perspective view of yet another embodiment of a blank.
Figure 28:
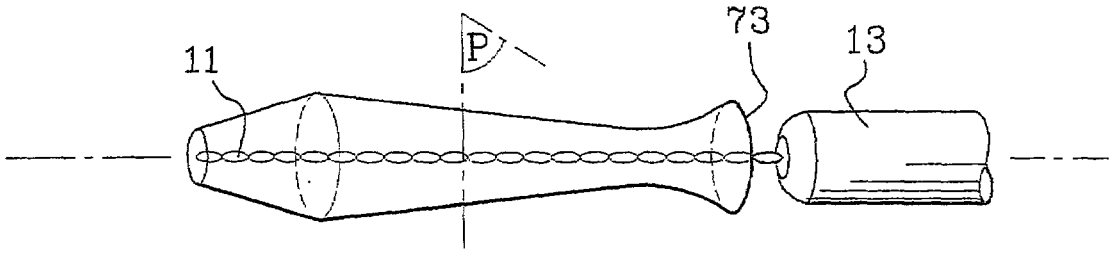
FIG. 28 is a perspective view of an additional embodiment of a blank.

According to another exemplary aspect, to make a brush, it may be possible to start from blanks presenting a variety of shapes, a few non-exhaustive examples of which are shown in FIGS. 25 through 28. FIG. 25 shows a blank that is substantially bullet-shaped FIG. 26 shows a substantially buoy-shaped blank. And FIGS. 27 and 28 show substantially fish-shaped blanks.

FIGS. 37 through 40 show brushes that may be obtained from the blanks shown in FIGS. 25 through 28, respectively.

Figure 29:
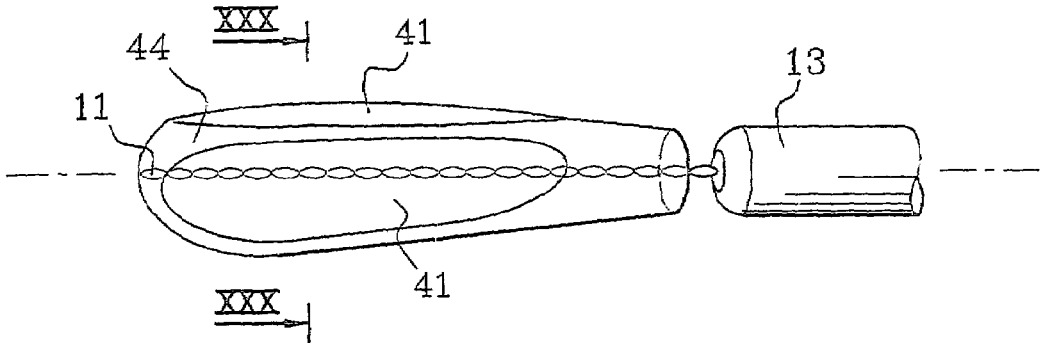
FIG. 29 shows a blank obtained from the blank of FIG. 25 following manufacturing.
Figure 30:
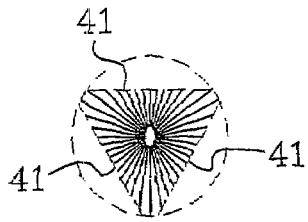
FIG. 30 is a cross-section view taken along line XXX—XXX of FIG. 29.
Figure 37:
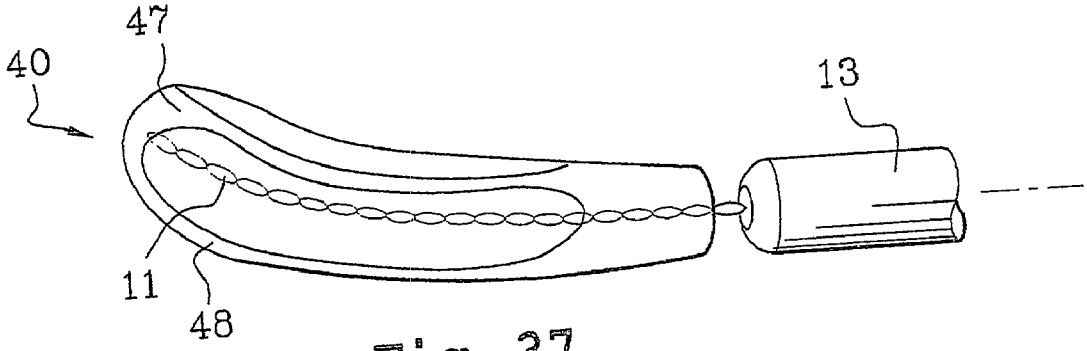
FIG. 37 is a schematic perspective view of an embodiment of a brush obtained from the blank of FIG. 29.

According to an exemplary aspect, to make the brush 40 shown in FIG. 37, the first step may be to form three substantially planar facets 41 on the blank of FIG. 25 so as to obtain a cross-section that is substantially triangular (see, e.g., FIGS. 29 and 30). The core 11 may be deformed in such a manner as to straighten out the end portion 42 (see FIG. 25) of the brush 40 that extends between its free end and the circle 43 of maximum diameter. The consequence of this deformation may be to straighten out the top edge 44 of the end portion of the FIG. 25 blank so as to bring it at least partially substantially into line with the top edge 46 of the portion 45 of the blank which extends between the circle 43 and the end situated adjacent the stem 13. In the brush 40 of FIG. 37, the portion of the brush 40 adjacent to the stem 13 may be relatively small in diameter and may lie substantially along the axis of the stem's end portion, thus enabling that brush portion to be wiped relatively uniformly. The end region 47 of the brush 40 situated adjacent the substantially concave side of the core 11 may be relatively far off-center from the stem's end portion and may be wiped more thoroughly as a result. The opposite region 48 may lie substantially along the stem's end portion and may be wiped relatively less thoroughly (e.g., such that a larger quantity of product may accumulate in region 48). Thus, once the brush 40 has been withdrawn from an optional receptacle and wiped in the process, it may carry one region (e.g., region 48) that is heavily loaded with product and another region (e.g., end region 47) that is more lightly loaded. The more lightly loaded region may be suitable for use in separating small eyelashes that are present at the ends of an eyelid.

Figure 31:
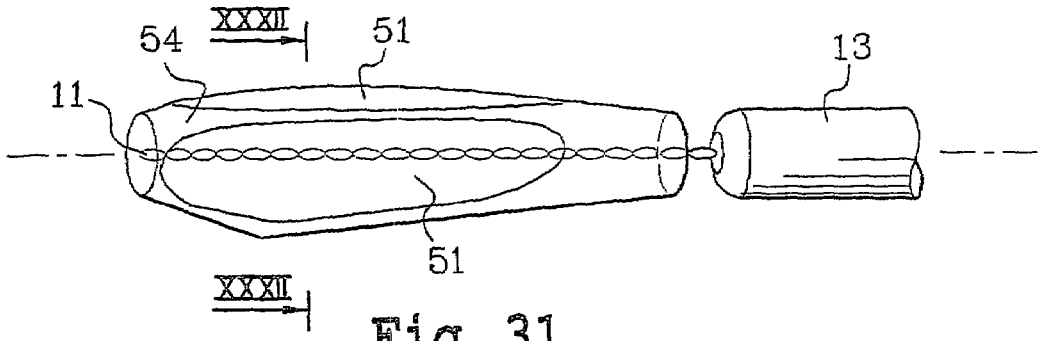
FIG. 31 shows a blank obtained from the blank of FIG. 26 following manufacturing.
Figure 32:
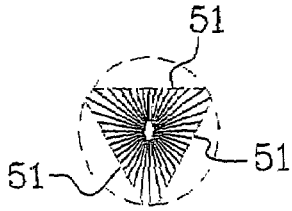
FIG. 32 is a cross-section view taken along line XXXII—XXXII of FIG. 31.
Figure 38:
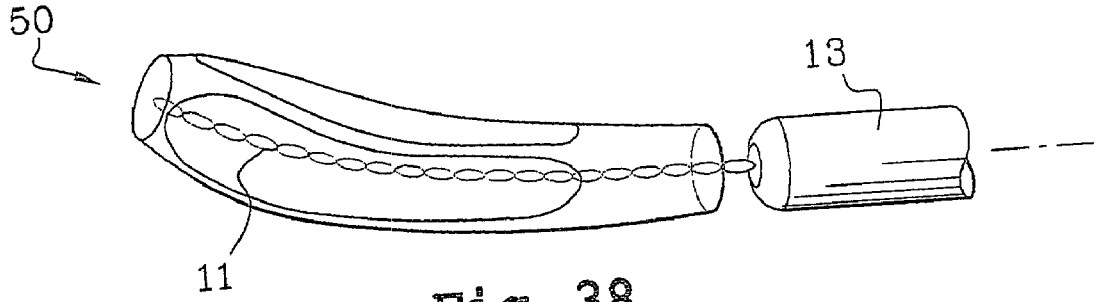
FIG. 38 is a schematic perspective view of an embodiment of a brush obtained from the blank of FIG. 31.

To make the brush 50 of FIG. 38 from the blank shown in FIG. 26, the brush is initially cut so as to form three substantially plane facets 51 as shown in FIGS. 31 and 32, these facets extending parallel to the axis of the core 11, and then the core 11 is curved in such a manner that the top edge 54 of the portion of the FIG. 26 blank that extends between its free end and the maximum diameter circle 53 straightens out so as to lie substantially in line with the top edge 56 of the portion 55 of the blank of FIG. 26 that extends between the maximum diameter circle 53 and the adjacent end of the stem 13.

Figure 33:
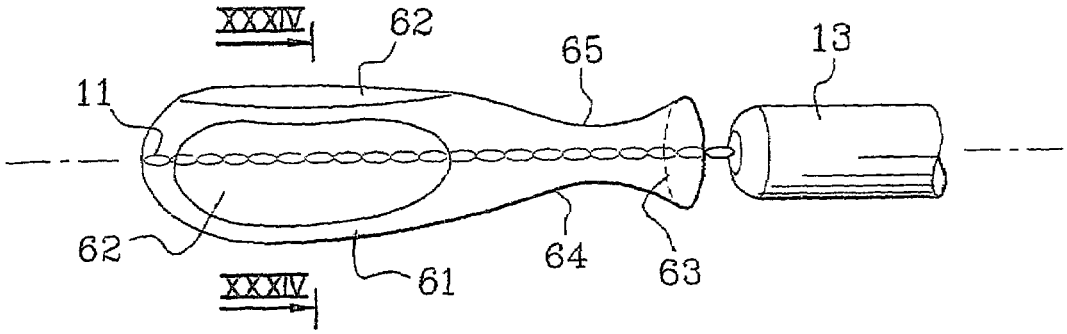
FIG. 33 shows a blank obtained from the blank of FIG. 27 following manufacturing.
Figure 34:
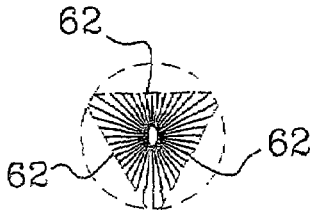
FIG. 34 is a cross-section view taken along line XXXIV—XXXIV of FIG. 33.
Figure 39:
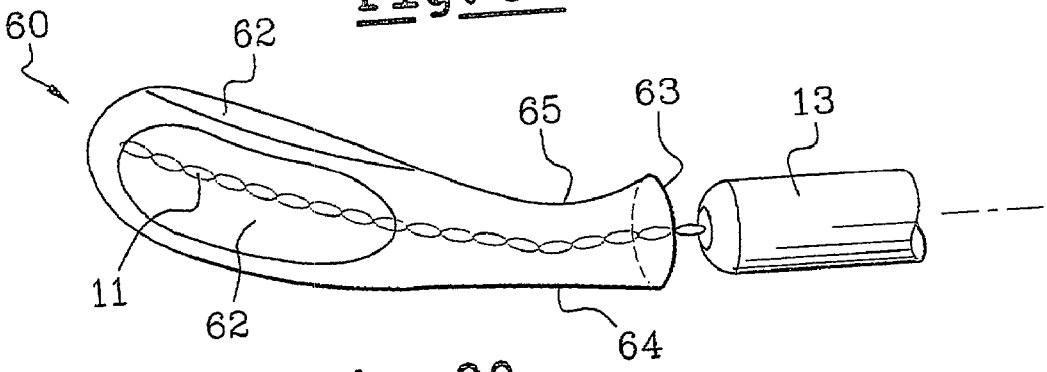
FIG. 39 is a schematic perspective view of an embodiment of a brush obtained from the blank of FIG. 33.

According to an exemplary aspect, to make brush 60 as shown in FIG. 39 from the blank shown in FIG. 27, three substantially planar facets 42 may be initially formed in a substantially triangular configuration on its swollen portion 61. To form these facets 42, in the example described, the blank may be cut on each occasion in a plane which extends at a distance from the core 11 that is greater than the radius of the circle 63 defined by the end of the blank adjacent to the stem 13. This may result in a blank having the shape shown in FIGS. 33 and 34. Thereafter, the core 11 may be deformed in such a manner as to straighten out the bottom edge 64 of the blank (i.e., the edge extending between the swollen portion 61 and the end circle 63) in such a manner as to flatten it. The top edge 65 (i.e., the edge diametrically opposite from the edge 64) may become indented to a greater extent because of the curvature imparted to the core 11.

Figure 35:
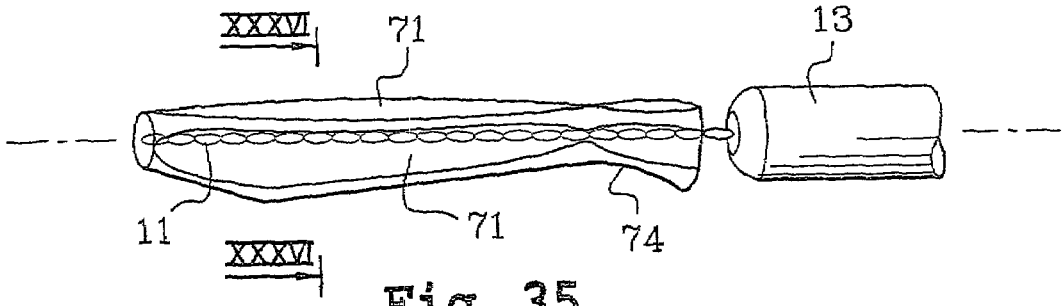
FIG. 35 shows a blank obtained from the blank of FIG. 28 following manufacturing.
Figure 36:
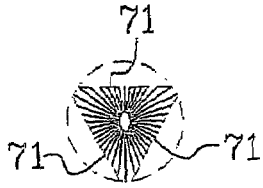
FIG. 36 is a cross-section view taken along line XXXVI—XXXVI of FIG. 35.
Figure 40:
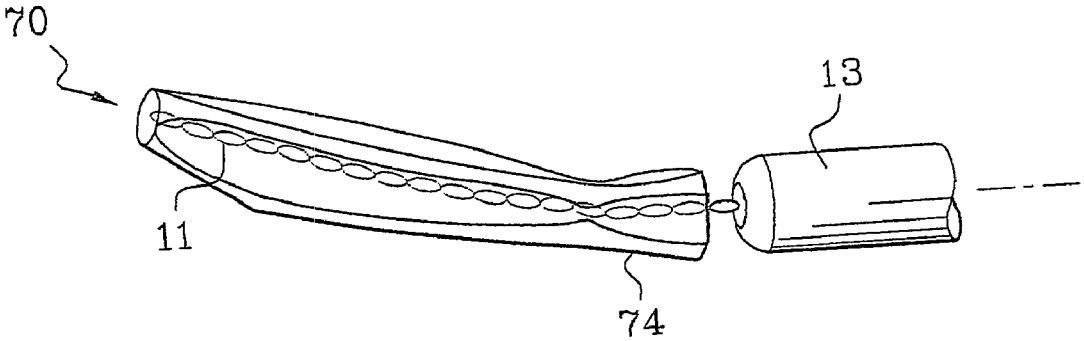
FIG. 40 is a schematic perspective view of an embodiment of a brush obtained from the blank of FIG. 35.

According to an additional exemplary aspect, to make the brush 70 shown in FIG. 40 from the substantially fish-shaped blank shown in FIG. 28, the first operation may be to form (e.g., via cutting) the blank in such a manner as to make three planar facets 71 in a triangular configuration, so as to obtain the blank shown in FIG. 35.

In the exemplary blank shown in FIG. 27, the end of the blank remote from the stem 13 is substantially egg-shaped, whereas in the exemplary embodiment shown in FIG. 28, the corresponding remote end is substantially frustoconical. Furthermore, unlike the example shown in FIG. 27, the plane on which the facets may be cut, intercept the circle 73 defined by the end of the blank situated adjacent the stem 13. The core 11 of the FIG. 35 blank may then be curved so as to flatten out the bottom edge 74 in its portion extending between the body of the brush 70 and the part adjacent to the stem 13.

Figure 47:
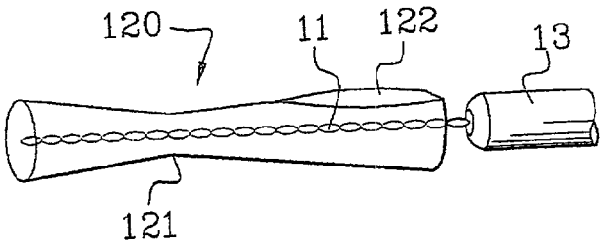
FIG. 47 is a perspective view of another embodiment of a blank.
Figure 48:
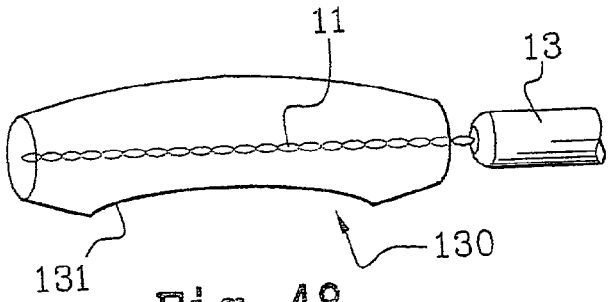
FIG. 48 is a perspective view of an additional embodiment of a blank.

FIGS. 47 and 48 show two other blanks prior to their cores being curved. The blank 120 shown in FIG. 47 may be substantially hourglass-shaped, having at least one facet 122 formed on one of its truncated cones. The core 11 may then be curved in the vicinity of the junction between the truncated cones so as to flatten out the concave edge 121 of one of the sides.

The brush 130 shown in FIG. 48 is substantially in the form of a football having a notch 131. Its core 11 may be subsequently curved to flatten out the notch 131.

Figure 41:
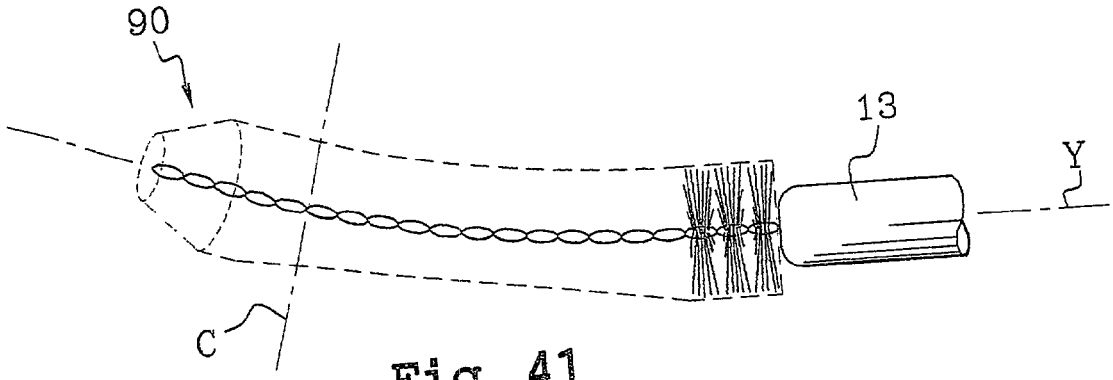
FIG. 41 is a side view of an embodiment of a brush.

In the examples of FIGS. 37 through 40, the plane of curvature of the core 11 is substantially perpendicular to one of the planar sides of the starting brush. The invention, however, is not limited to the examples described above. Optionally, additional curvature may be imparted to the core 11 so that it no longer extends entirely in a single plane of curvature. For example, FIG. 41 shows a brush 90 obtained by imparting additional curvature to the core of the exemplary brush shown in FIG. 6 about an axis C which may be parallel to the plane of FIG. 41. By curving the core 11 about two non-parallel axes, it may be possible to further modify the shape of the brush. For example, it may be possible to obtain a brush whose portion adjacent to the stem 13 is wiped in a substantially uniform manner, while an end portion has zones that are wiped in a substantially non-uniform manner.

Figure 42:
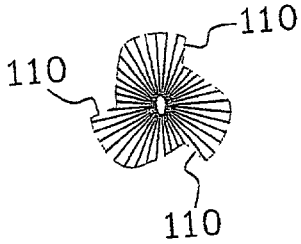
FIG. 42 is a cross-sectional view of another embodiment of a brush.

According to another exemplary embodiment, it may also be possible to make steps in a brush according to the invention. As shown in FIG. 42, the brush has been formed (e.g., machined) in such a manner as to form setbacks 110 in its surface extending over at least a portion of its length and to form flanks that are substantially radial.

Figure 43:
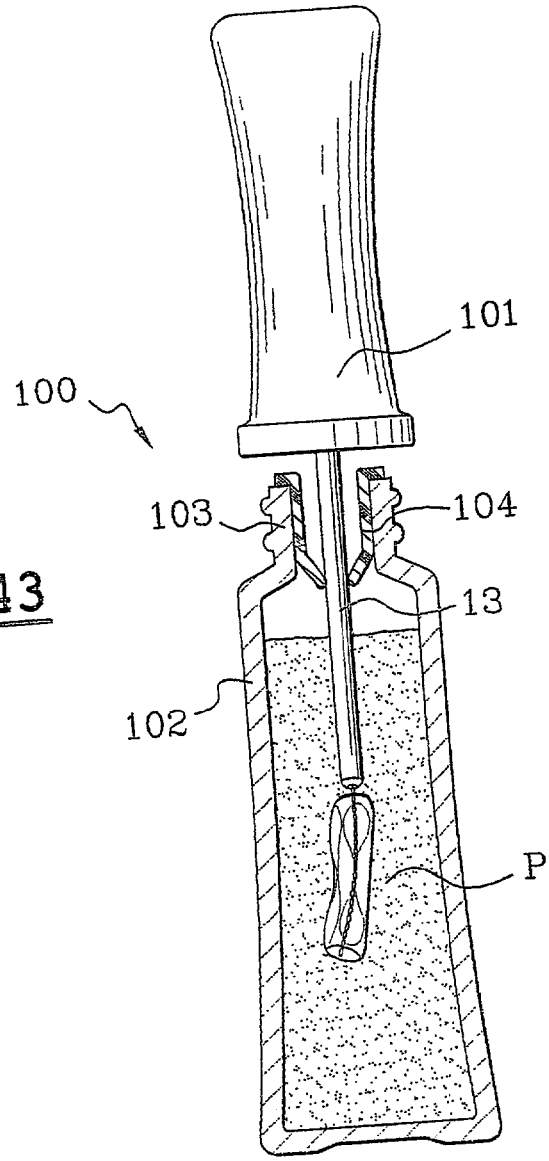
FIG. 43 is a partial sectional view of an embodiment of a system including a brush.

FIG. 43 shows a system 100 which includes a brush as described herein. The stem 13 may be fixed to a cap 101 which may serve both as a handle member and as a member for providing substantially leakproof closure of the receptacle 102 which contains product P, for example, to be applied to the eyelashes. The receptacle 102 may have a neck 103 with an outside thread and contain a wiper 104 which may be of any conventional type, and which may be adapted to wipe the stem 13 as cap 101 is removed from the receptacle 102.

Figure 44:
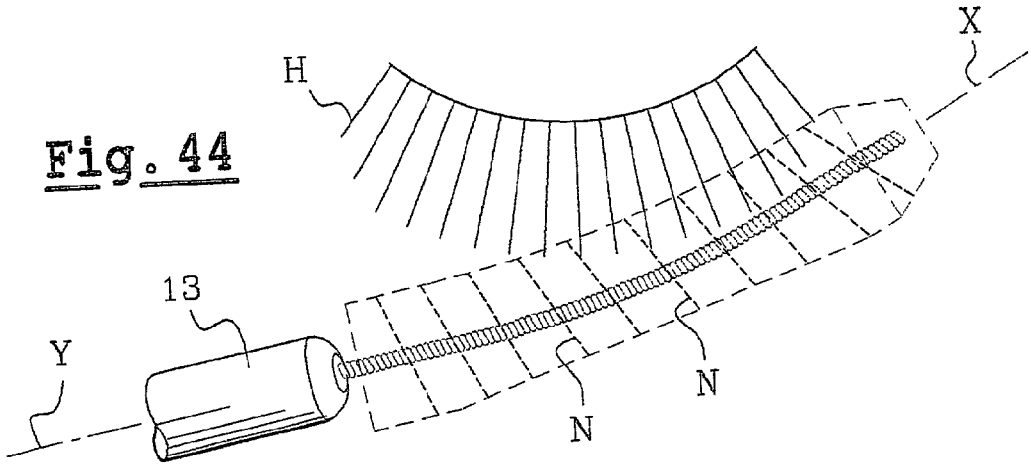
FIG. 44 is a diagram showing an embodiment of a brush while applying substance to eyelashes.
Figure 45:
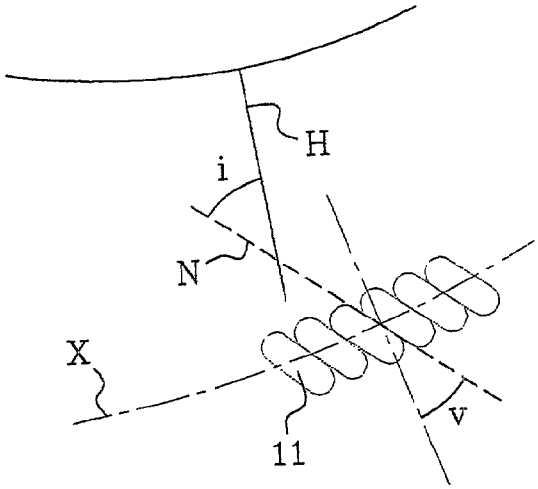
FIG. 45 is a diagram showing exemplary angular relationships between a helical sheet and core axis of a brush, and an eyelash.

It may be particularly advantageous to start from a blank having a left-hand pitch, as explained below with reference to FIGS. 44 and 45. In FIG. 45, for example, the brush of FIG. 6 is provided with a core that is twisted with a left-hand pitch. Dashed lines represent the paths that may be followed by sheets N defined by the ends of the bristles. These sheets N may be at an angle v with respect to a plane perpendicular to the core. As shown in FIG. 44, the angles of the sheets N relative to the axis Y of the stem 13 decrease as they approach the free end of the brush, thus making it possible to conserve a relatively large angle i between the sheets N and the eyelashes H at the end of the eyelid, thereby enabling the eyelashes to be well separated by the brush.

Figure 46:
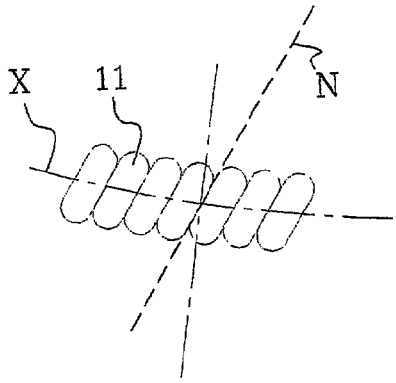
FIG. 46 is a diagram similar to that of FIG. 45 showing a right-hand pitch brush.
Figure 49:
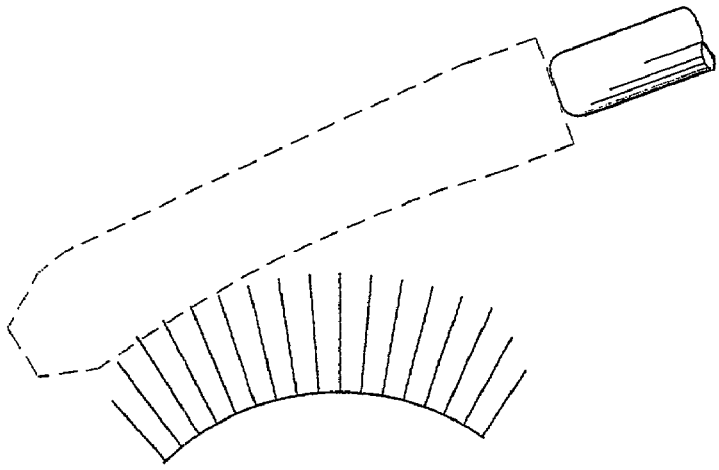
FIG. 49 is a diagram of an embodiment of a brush in use to apply product to the eyelashes situated at one end of an eyelid.
Figure 50:
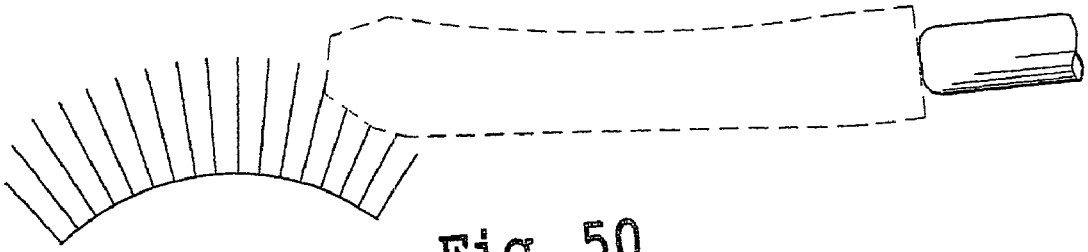
FIG. 50 is a diagram of the brush embodiment of FIG. 49 being used to apply product to the eyelashes situated at the opposite end of the eyelid.

As shown in FIG. 46, when the core 11 is not straight, the curvature imparted to the core 11 may also serve to bring the bristles into the desired orientation. FIG. 49 shows the brush of FIG. 6 in use for making up eyelashes situated at one end of an eyelid, with the curved side of the brush being used. FIG. 50, on the other hand, shows the eyelashes situated at the opposite side of the eyelid being made up with the end of the brush being used on its substantially rectilinear side.

Figure 51:
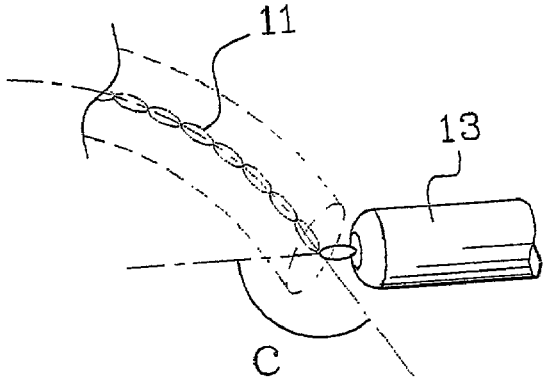
FIG. 51 is a fragmentary perspective view of another embodiment of a brush.

According to another exemplary embodiment, FIG. 51 shows a brush provided with an angled bend in the core 11 adjacent to the stem 13.

In the figures, the curvature of the core has been exaggerated in order to make the invention easier to understand. It would not go beyond the ambit of the present invention for the curvature to be less marked (e.g., so as to match the curvature of an eyelid). The core may also be curved to have an S-shape lying in, for example, a single plane of curvature.

It is contemplated that at least one applicator surface of a brush may be substantially parallel to the stem while having a portion that is off-axis.

A brush according to some exemplary embodiments of the invention may be particularly ergonomic to use in numerous positions.

A brush according to some exemplary embodiments of the invention may make it possible to obtain a brush presenting faces of different shapes so as to obtain different effects. For example, according to some exemplary embodiments of the invention, it may be possible to obtain brushes which have a substantially planar face on one side and a face that is one of substantially concave and substantially convex on an opposite side.

It may also be possible according to some exemplary embodiments of the invention to make brushes having a substantially rectilinear edge (e.g., a ridge) on one side, while having a face that is one of substantially concave and substantially convex on a diametrically opposite side.

Finally, the invention according to some exemplary embodiments may provide a novel generation of brushes conserving numerous advantages obtained by means of previously developed brushes while also managing eyelashes better (i.e., because of the way in which the profile of the brush may vary as it turned about the axis of the stem while it is in contact with the eyelashes, and because of the curvature of the core which may impart lateral motion to the bristles of the brush that may encourage them to penetrate between the eyelashes).

The brush according to some exemplary embodiments of the invention may be used to apply any make-up or care products, such as cosmetic, dermatological, or pharmaceutical compositions used for treating eyelashes, hair, skin, lips, or nails. However, in its broadest aspects, the present invention could be used to apply many other substances.

Furthermore, sizes of various structural parts and materials used to make the above-mentioned parts are illustrative and exemplary only, and one of ordinary skill in the art would recognize that these sizes and materials can be changed as necessary to produce different effects or desired characteristics.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A brush comprising:

a core curved along at least a portion of its length so that an axis of the core defines a curve in a plane of curvature; and a plurality of bristles connected to the core, the bristles defining a cross-section of the brush that varies over at least a portion of the length of the core in a manner that is not geometrically similar, wherein the cross-section of the brush at at least one position along the length of the core is substantially asymmetric in relation to a plane perpendicular to the plane of curvature, and wherein the core passes through the center of the cross-section of the brush at at least one location along the length of the core.

2. The brush of claim 1, wherein the brush comprises at least three side faces having shapes differing from one another.

3. The brush of claim 1, wherein, when the core is straightened, the bristles define a notch defining a maximum width between ends of the notch.

4. The brush of claim 1, wherein, when the core is straightened, the bristles define a notch, the notch being concave in a direction substantially perpendicular to the core.

5. The brush of claim 3, wherein the notch is partially cylindrical about an axis perpendicular to the axis of the core when the core is straightened.

6. The brush of claim 3, wherein the notch is concave.

7. The brush of claim 3, wherein, when the core is straightened, the bristles define an odd number of notches.

8. The brush of claim 7, wherein the number of notches is one of three, five, and seven.

9. The brush of claim 1, wherein, when the core is straightened, the bristles define at least four side faces, two of the four side faces being substantially planar and two of the four side faces not being substantially planar, wherein the two substantially planar side faces are adjacent to one another and the two side faces that are not substantially planar are adjacent to one another.

10. The brush of claim 1, wherein the bristles define at least one cross-section that is substantially rectangular, and wherein, when the core is straightened, the bristles define two adjacent substantially planar faces and two adjacent concave faces.

11. The brush of claim 1, wherein, when the core is straightened, the bristles define a general peanut shape having at least one flat side.

12. The brush of claim 1, wherein, when the core is straightened, the bristles define a general peanut shape having at least three substantially planar facets defining a substantially triangular shaped cross-section along a portion of the length of the brush.

13. The brush of claim 1, wherein the brush is made from a blank having a general shape chosen from a substantially bullet shape, a substantially peanut shape, a substantially buoy shape, a substantially fish shape, a substantially hourglass shape, and a substantially football shape.

14. The brush of claim 13, wherein the bristles define a cross-section having at least one of a maximum cross-sectional area and a minimum cross-sectional area located between two axial ends of the brush.

15. The brush of claim 1, wherein the core is located off-center in the cross-section of the brush over at least a portion of the length of the brush.

16. The brush of claim 1, wherein the core comprises a twisted wire core having one of a left-hand pitch and a right-hand pitch.

17. The brush of claim 16, further comprising a stem connected to the core and having an axis, the stem being located at one end of the core, the core having a left-hand pitch and being curved in a manner so as to decrease inclination of helical sheets formed by ends of the bristles relative to the axis of the stem in a direction facing away from the stem.

18. The brush of claim 1, wherein the bristles have differing lengths.

19. The brush of claim 18, wherein longer bristles define an envelope surface defining a volume containing shorter bristles.

20. The brush of claim 1, wherein the cross-section includes peripheral steps over at least a portion of the length of the core.

21. The brush of claim 1, wherein the core passes through a point other than the center of the cross-section of the brush at at least one location along the length of the core.

22. The brush of claim 21, further comprising a stem connected to the core, wherein the at least one location along the length of the core where the core passes through the center of the cross-section of the brush is located adjacent the stem.

23. The brush of claim 21, wherein the at least one location along the length of the core where the core passes through the center of the cross-section of the brush is located at a free end of the core.

24. A system comprising:

the brush of claim 1; and a reservoir configured to contain a product to be applied by the brush.

25. The system of claim 24, further comprising product contained in the reservoir, wherein the product is a hair product.

26. The system of claim 25, wherein the product is mascara.

27. The system of claim 24, further comprising a wiper associated with the reservoir.

28. The system of claim 24, wherein the brush comprises a cap configured to close the reservoir.

29. A method of applying product to keratinous fibers, comprising:

providing the brush of claim 1;

loading the brush with product; and applying the product to keratinous fibers with the brush.

30. The method of claim 29, wherein the keratinous fibers are eyelashes.

31. A brush comprising:

a core curved along at least a portion of its length so that an axis of the core defines a curve in a plane of curvature, the curve having a convex side and a concave side; and a plurality of bristles connected to the core, the bristles comprising ends defining an envelope surface of the brush and the bristles defining a cross-section of the brush that varies over at least a portion of the length of the core in a manner that is not geometrically similar, wherein the cross-section of the brush at at least one position along the length of the core is substantially asymmetric in relation to a plane perpendicular to the plane of curvature, and wherein, in the plane of curvature, the distance from the convex side of the curve to the envelope surface varies along at least a portion of the length of the core.

32. The brush of claim 31, wherein the brush comprises at least three side faces having shapes differing from one another.

33. The brush of claim 31, wherein, when the core is straightened, the bristles define a notch defining a maximum width between ends of the notch.

34. The brush of claim 31, wherein, when the core is straightened, the bristles define a notch, the notch being concave in a direction substantially perpendicular to the core.

35. The brush of claim 33, wherein the notch is partially cylindrical about an axis perpendicular to the axis of the core when the core is straightened.

36. The brush of claim 33, wherein the notch is concave.

37. The brush of claim 33, wherein, when the core is straightened, the bristles define an odd number of notches.

38. The brush of claim 37, wherein the number of notches is one of three, five, and seven.

39. The brush of claim 31, wherein, when the core is straightened, the bristles define at least four side faces, two of the four side faces being substantially planar and two of the four side faces not being substantially planar, wherein the two substantially planar side faces are adjacent to one another and the two side faces that are not substantially planar are adjacent to one another.

40. The brush of claim 31, wherein the bristles define at least one cross-section that is substantially rectangular, and wherein, when the core is straightened, the bristles define two adjacent substantially planar faces and two adjacent concave faces.

41. The brush of claim 31, wherein, when the core is straightened, the bristles define a general peanut shape having at least one flat side.

42. The brush of claim 31, wherein, when the core is straightened, the bristles define a general peanut shape having at least three substantially planar facets defining a substantially triangular shaped cross-section along a portion of the length of the brush.

43. The brush of claim 31, wherein the brush is made from a blank having a general shape chosen from a substantially bullet shape, a substantially peanut shape, a substantially buoy shape, a substantially fish shape, a substantially hourglass shape, and a substantially football shape.

44. The brush of claim 43, wherein the bristles define a cross-section having at least one of a maximum cross-sectional area and a minimum cross-sectional area located between two axial ends of the brush.

45. The brush of claim 31, wherein the core is located off-center in the cross-section of the brush over at least a portion of the length of the brush.

46. The brush of claim 31, wherein the core comprises a twisted wire core having one of a left-hand pitch and a right-hand pitch.

47. The brush of claim 46, further comprising a stem connected to the core and having an axis, the stem being located at one end of the core, the core having a left-hand pitch and being curved in a manner so as to decrease inclination of helical sheets formed by ends of the bristles relative to the axis of the stem in a direction facing away from the stem.

48. The brush of claim 31, wherein the bristles have differing lengths.

49. The brush of claim 48, wherein longer bristles define an envelope surface defining a volume containing shorter bristles.

50. The brush of claim 31, wherein the cross-section includes peripheral steps over at least a portion of the length of the core.

51. The brush of claim 31, wherein the core passes through the center of the cross-section of the brush at at least one location along the length of the core and the core passes through a point other than the center of the cross-section of the brush at at least one location along the length of the core.

52. The brush of claim 51, further comprising a stem connected to the core, wherein the at least one location along the length of the core where the core passes through the center of the cross-section of the brush is located adjacent the stem.

53. The brush of claim 51, wherein the at least one location along the length of the core where the core passes through the center of the cross-section of the brush is located at a free end of the core.

54. A system comprising:

the brush of claim 31; and a reservoir configured to contain a product to be applied by the brush.

55. The system of claim 54, further comprising product contained in the reservoir, wherein the product is a hair product.

56. The system of claim 55, wherein the product is mascara.

57. The system of claim 54, further comprising a wiper associated with the reservoir.

58. The system of claim 54, wherein the brush comprises a cap configured to close the reservoir.

59. A method of applying product to keratinous fibers, comprising:

providing the brush of claim 31;

loading the brush with product; and applying the product to keratinous fibers with the brush.

60. The method of claim 59, wherein the keratinous fibers are eyelashes.

61. A brush comprising:

a core curved along at least a portion of its length so that an axis of the core defines a curve in a plane of curvature; and a plurality of bristles connected to the core, the bristles defining a cross-section of the brush that varies over at least a portion of the length of the core in a manner that is not geometrically similar, wherein the cross-section of the brush at at least one position along the length of the core is substantially asymmetric in relation to a plane perpendicular to the plane of curvature, and wherein, when the core is straightened, ends of the bristles define at least one notch having a maximum width located between ends of the notch spaced apart from one another along the length of the brush.

62. The brush of claim 61, wherein the brush comprises at least three side faces having shapes differing from one another.

63. The brush of claim 61, further comprising at least one additional notch.

64. The brush of claim 61, wherein the notch is concave in a direction substantially perpendicular to the core.

65. The brush of claim 61, wherein the notch is partially cylindrical about an axis perpendicular to the axis of the core when the core is straightened.

66. The brush of claim 61, wherein the notch is concave.

67. The brush of claim 61, wherein, when the core is straightened, the bristles define an odd number of notches.

68. The brush of claim 67, wherein the number of notches is one of three, five, and seven.

69. The brush of claim 61, wherein, when the core is straightened, the bristles define at least four side faces, two of the four side faces being substantially planar and two of the four side faces not being substantially planar, wherein the two substantially planar side faces are adjacent to one another and the two side faces that are not substantially planar are adjacent to one another.

70. The brush of claim 61, wherein the bristles define at least one cross-section that is substantially rectangular, and wherein, when the core is straightened, the bristles define two adjacent substantially planar faces and two adjacent concave faces.

71. The brush of claim 61, wherein, when the core is straightened, the bristles define a general peanut shape having at least one flat side.

72. The brush of claim 61, wherein, when the core is straightened, the bristles define a general peanut shape having at least three substantially planar facets defining a substantially triangular shaped cross-section along a portion of the length of the brush.

73. The brush of claim 61, wherein the brush is made from a blank having a general shape chosen from a substantially bullet shape, a substantially peanut shape, a substantially buoy shape, a substantially fish shape, a substantially hour-glass shape, and a substantially football shape.

74. The brush of claim 73, wherein the bristles define a cross-section having at least one of a maximum cross-sectional area and a minimum cross-sectional area located between two axial ends of the brush.

75. The brush of claim 61, wherein the core is located off-center in the cross-section of the brush over at least a portion of the length of the brush.

76. The brush of claim 61, wherein the core comprises a twisted wire core having one of a left-hand pitch and a right-hand pitch.

77. The brush of claim 76, further comprising a stem connected to the core and having an axis, the stem being located at one end of the core, the core having a left-hand pitch and being curved in a manner so as to decrease inclination of helical sheets formed by ends of the bristles relative to the axis of the stem in a direction facing away from the stem.

78. The brush of claim 61, wherein the bristles have differing lengths.

79. The brush of claim 78, wherein longer bristles define an envelope surface defining a volume containing shorter bristles.

80. The brush of claim 61, wherein the cross-section includes peripheral steps over at least a portion of the length of the core.

81. The brush of claim 61, wherein the core passes through the center of the cross-section of the brush at at least one location along the length of the core and the core passes through a point other than the center of the cross-section of the brush at at least one location along the length of the core.

82. The brush of claim 81, further comprising a stem connected to the core, wherein the at least one location along the length of the core where the core passes through the center of the cross-section of the brush is located adjacent the stem.

83. The brush of claim 81, wherein the at least one location along the length of the core where the core passes through the center of the cross-section of the brush is located at a free end of the core.

84. A system comprising:

the brush of claim 61; and a reservoir configured to contain a product to be applied by the brush.

85. The system of claim 84, further comprising product contained in the reservoir, wherein the product is a hair product.

86. The system of claim 85, wherein the product is mascara.

87. The system of claim 84, further comprising a wiper associated with the reservoir.

88. The system of claim 84, wherein the brush comprises a cap configured to close the reservoir.

89. A method of applying product to keratinous fibers, comprising:

providing the brush of claim 61;

loading the brush with product; and applying the product to keratinous fibers with the brush.

90. The method of claim 89, wherein the keratinous fibers are eyelashes.

91. A brush comprising:

a core curved along at least a portion of its length so that an axis of the core defines a curve in a plane of curvature; and a plurality of bristles connected to the core, the bristles defining a cross-section of the brush that varies over at least a portion of the length of the core in a manner that is not geometrically similar, wherein the cross-section of the brush at at least one position along the length of the core is substantially asymmetric in relation to a plane perpendicular to the plane of curvature, and wherein, when the core is straightened, ends of the bristles define at least one notch, the notch being concave in at least one plane intersecting the notch.

92. The brush of claim 91, wherein the brush comprises at least three side faces having shapes differing from one another.

93. The brush of claim 91, wherein the notch has a maximum width between ends of the notch.

94. The brush of claim 91, wherein the notch is concave in a direction substantially perpendicular to the core.

95. The brush of claim 93, wherein the notch is partially cylindrical about an axis perpendicular to the axis of the core when the core is straightened.

96. The brush of claim 93, wherein, when the core is straightened, the bristles define an odd number of notches.

97. The brush of claim 96, wherein the number of notches is one of three, five, and seven.

98. The brush of claim 91, wherein, when the core is straightened, the bristles define at least four side faces, two of the four side faces being substantially planar and two of the four side faces not being substantially planar, wherein the two substantially planar side faces are adjacent to one another and the two side faces that are not substantially planar are adjacent to one another.

99. The brush of claim 91, wherein the bristles define at least one cross-section that is substantially rectangular, and wherein, when the core is straightened, the bristles define two adjacent substantially planar faces and two adjacent concave faces.

100. The brush of claim 91, wherein, when the core is straightened, the bristles define a general peanut shape having at least one flat side.

101. The brush of claim 91, wherein, when the core is straightened, the bristles define a general peanut shape having at least three substantially planar facets defining a substantially triangular shaped cross-section along a portion of the length of the brush.

102. The brush of claim 91, wherein the brush is made from a blank having a general shape chosen from a substantially bullet shape, a substantially peanut shape, a substantially buoy shape, a substantially fish shape, a substantially hourglass shape, and a substantially football shape.

103. The brush of claim 102, wherein the bristles define a cross-section having at least one of a maximum cross-sectional area and a minimum cross-sectional area located between two axial ends of the brush.

104. The brush of claim 91, wherein the core is located off-center in the cross-section of the brush over at least a portion of the length of the brush.

105. The brush of claim 91, wherein the core comprises a twisted wire core having one of a left-hand pitch and a right-hand pitch.

106. The brush of claim 105, further comprising a stem connected to the core and having an axis, the stem being located at one end of the core, the core having a left-hand pitch and being curved in a manner so as to decrease inclination of helical sheets formed by ends of the bristles relative to the axis of the stem in a direction facing away from the stem.

107. The brush of claim 91, wherein the bristles have differing lengths.

108. The brush of claim 107, wherein longer bristles define an envelope surface defining a volume containing shorter bristles.

109. The brush of claim 91, wherein the cross-section includes peripheral steps over at least a portion of the length of the core.

110. The brush of claim 91, wherein the core passes through the center of the cross-section of the brush at at least one location along the length of the core and the core passes through a point other than the center of the cross-section of the brush at at least one location along the length of the core.

111. The brush of claim 110, further comprising a stem connected to the core, wherein the at least one location along the length of the core where the core passes through the center of the cross-section of the brush is located adjacent the stem.

112. The brush of claim 110, wherein the at least one location along the length of the core where the core passes through the center of the cross-section of the brush is located at a free end of the core.

113. A system comprising:

the brush of claim 91; and a reservoir configured to contain a product to be applied by the brush.

114. The system of claim 113, further comprising product contained in the reservoir, wherein the product is a hair product.

115. The system of claim 114, wherein the product is mascara.

116. The system of claim 113, further comprising a wiper associated with the reservoir.

117. The system of claim 113, wherein the brush comprises a cap configured to close the reservoir.

118. A method of applying product to keratinous fibers, comprising:

providing the brush of claim 91;

loading the brush with product; and applying the product to keratinous fibers with the brush.

119. The method of claim 118, wherein the keratinous fibers are eyelashes.

120. A brush comprising:

a core curved along at least a portion of its length so that an axis of the core defines a curve in a plane of curvature, the curve having a convex side and a concave side; and a plurality of bristles connected to the core, the bristles comprising ends defining an envelope surface of the brush and the bristles defining a cross-section of the brush that varies over at least a portion of the length of the core in a manner that is not geometrically similar, wherein the cross-section of the brush at at least one position along the length of the core is substantially asymmetric in relation to a plane perpendicular to the plane of curvature, and wherein the envelope surface on the convex side of the curve defines a substantially planar surface along at least a portion of the length of the brush, the substantially planar surface intersecting the plane of curvature.

121. The brush of claim 120, wherein the brush comprises at least three side faces having shapes differing from one another.

122. The brush of claim 120, wherein, when the core is straightened, the bristles define a notch defining a maximum width between ends of the notch.

123. The brush of claim 120, wherein, when the core is straightened, the bristles define a notch, the notch being concave in a direction substantially perpendicular to the core.

124. The brush of claim 122, wherein the notch is partially cylindrical about an axis perpendicular to the axis of the core when the core is straightened.

125. The brush of claim 122, wherein the notch is concave.

126. The brush of claim 122, wherein, when the core is straightened, the bristles define an odd number of notches.

127. The brush of claim 126, wherein the number of notches is one of three, five, and seven.

128. The brush of claim 120, wherein, when the core is straightened, the bristles define at least four side faces, two of the four side faces being substantially planar and two of the four side faces not being substantially planar, wherein the two substantially planar side faces are adjacent to one another and the two side faces that are not substantially planar are adjacent to one another.

129. The brush of claim 120, wherein the bristles define at least one cross-section that is substantially rectangular, and wherein, when the core is straightened, the bristles define two adjacent substantially planar faces and two adjacent concave faces.

130. The brush of claim 120, wherein, when the core is straightened, the bristles define a general peanut shape having at least one flat side.

131. The brush of claim 120, wherein, when the core is straightened, the bristles define a general peanut shape having at least three substantially planar facets defining a substantially triangular shaped cross-section along a portion of the length of the brush.

132. The brush of claim 120, wherein the brush is made from a blank having a general shape chosen from a substantially bullet shape, a substantially peanut shape, a substantially buoy shape, a substantially fish shape, a substantially hourglass shape, and a substantially football shape.

133. The brush of claim 132, wherein the bristles define a cross-section having at least one of a maximum cross-sectional area and a minimum cross-sectional area located between two axial ends of the brush.

134. The brush of claim 120, wherein the core is located off-center in the cross-section of the brush over at least a portion of the length of the brush.

135. The brush of claim 120, wherein the core comprises a twisted wire core having one of a left-hand pitch and a right-hand pitch.

136. The brush of claim 135, further comprising a stem connected to the core and having an axis, the stem being located at one end of the core, the core having a left-hand pitch and being curved in a manner so as to decrease inclination of helical sheets formed by ends of the bristles relative to the axis of the stem in a direction facing away from the stem.

137. The brush of claim 120, wherein the bristles have differing lengths.

138. The brush of claim 137, wherein the bristles comprise longer bristles having ends defining the envelope surface and shorter bristles contained within a volume defined by the envelope surface.

139. The brush of claim 120, wherein the cross-section includes peripheral steps over at least a portion of the length of the core.

140. The brush of claim 120, wherein the core passes through the center of the cross-section of the brush at at least one location along the length of the core and the core passes through a point other than the center of the cross-section of the brush at at least one location along the length of the core.

141. The brush of claim 140, further comprising a stem connected to the core, wherein the at least one location along the length of the core where the core passes through the center of the cross-section of the brush is located adjacent the stem.

142. The brush of claim 140, wherein the at least one location along the length of the core where the core passes through the center of the cross-section of the brush is located at a free end of the core.

143. A system comprising:

the brush of claim 120; and a reservoir configured to contain a product to be applied by the brush.

144. The system of claim 143, further comprising product contained in the reservoir, wherein the product is a hair product.

145. The system of claim 144, wherein the product is mascara.

146. The system of claim 143, further comprising a wiper associated with the reservoir.

147. The system of claim 143, wherein the brush comprises a cap configured to close the reservoir.

148. A method of applying product to keratinous fibers, comprising:

providing the brush of claim 120;

loading the brush with product; and applying the product to keratinous fibers with the brush.

149. The method of claim 148, wherein the keratinous fibers are eyelashes.

150. A brush comprising:

a core curved along at least a portion of its length so that an axis of the core defines a curve in a plane of curvature, the curve having a convex side and a concave side; and a plurality of bristles connected to the core, the bristles comprising ends defining an envelope surface of the brush and the bristles defining a cross-section of the brush that varies over at least a portion of the length of the core in a manner that is not geometrically similar, wherein the cross-section of the brush at at least one position along the length of the core is substantially asymmetric in relation to a plane perpendicular to the plane of curvature, and wherein, in the plane of curvature, the envelope surface on the convex side of the curve defines a substantially rectilinear edge along at least a portion of the length of the brush.

151. The brush of claim 150, wherein the brush comprises at least three side faces having shapes differing from one another.

152. The brush of claim 150, wherein, when the core is straightened, the bristles define a notch defining a maximum width between ends of the notch.

153. The brush of claim 150, wherein, when the core is straightened, the bristles define a notch, the notch being concave in a direction substantially perpendicular to the core.

154. The brush of claim 152, wherein the notch is partially cylindrical about an axis perpendicular to the axis of the core when the core is straightened.

155. The brush of claim 152, wherein the notch is concave.

156. The brush of claim 152, wherein, when the core is straightened, the bristles define an odd number of notches.

157. The brush of claim 156, wherein the number of notches is one of three, five, and seven.

158. The brush of claim 150, wherein, when the core is straightened, the bristles define at least four side faces, two of the four side faces being substantially planar and two of the four side faces not being substantially planar, wherein the two substantially planar side faces are adjacent to one another and the two side faces that are not substantially planar are adjacent one another.

159. The brush of claim 150, wherein the bristles define at least one cross-section that is substantially rectangular, and wherein, when the core is straightened, the bristles define two adjacent substantially planar faces and two adjacent concave faces.

160. The brush of claim 150, wherein, when the core is straightened, the bristles define a general peanut shape having at least one flat side.

161. The brush of claim 150, wherein, when the core is straightened, the bristles define a general peanut shape having at least three substantially planar facets defining a substantially triangular shaped cross-section along a portion of the length of the brush.

162. The brush of claim 150, wherein the brush is made from a blank having a general shape chosen from a substantially bullet shape, a substantially peanut shape, a substantially buoy shape, a substantially fish shape, a substantially hourglass shape, and a substantially football shape.

163. The brush of claim 162, wherein the bristles define a cross-section having at least one of a maximum cross-sectional area and a minimum cross-sectional area located between two axial ends of the brush.

164. The brush of claim 150, wherein the core is located off-center in the cross-section of the brush over at least a portion of the length of the brush.

165. The brush of claim 150, wherein the core comprises a twisted wire core having one of a left-hand pitch and a right-hand pitch.

166. The brush of claim 165, further comprising a stem connected to the core and having an axis, the stem being located at one end of the core, the core having a left-hand pitch and being curved in a manner so as to decrease inclination of helical sheets formed by ends of the bristles relative to the axis of the stem in a direction facing away from the stem.

167. The brush of claim 150, wherein the bristles have differing lengths.

168. The brush of claim 167, wherein the bristles comprise longer bristles having ends defining the envelope surface and shorter bristles contained within a volume defined by the envelope surface.

169. The brush of claim 150, wherein the cross-section includes peripheral steps over at least a portion of the length of the core.

170. The brush of claim 150, wherein the core passes through the center of the cross-section of the brush at at least one location along the length of the core and the core passes through a point other than the center of the cross-section of the brush at at least one location along the length of the core.

171. The brush of claim 170, further comprising a stem connected to the core, wherein the at least one location along the length of the core where the core passes through the center of the cross-section of the brush is located adjacent the stem.

172. The brush of claim 170, wherein the at least one location along the length of the core where the core passes through the center of the cross-section of the brush is located at a free end of the core.

173. A system comprising:

the brush of claim 150; and a reservoir configured to contain a product to be applied by the brush.

174. The system of claim 173, further comprising product contained in the reservoir, wherein the product is a hair product.

175. The system of claim 174, wherein the product is mascara.

176. The system of claim 173, further comprising a wiper associated with the reservoir.

177. The system of claim 173, wherein the brush comprises a cap configured to close the reservoir.

178. A method of applying product to keratinous fibers, comprising:

providing the brush of claim 150;

loading the brush with product; and applying the product to keratinous fibers with the brush.

179. The method of claim 178, wherein the keratinous fibers are eyelashes.

180. A brush comprising:

a core curved along at least a portion of its length so that an axis of the core defines a curve in a plane of curvature;

a plurality of bristles connected to the core, the bristles defining a cross-section of the brush that varies over at least a portion of the length of the core in a manner that is not geometrically similar, wherein the cross-section of the brush at at least one position along the length of the core is substantially asymmetric in relation to a plane perpendicular to the plane of curvature; and a stem having an end portion connected to the core, the end portion of the stem defining an axis, wherein the brush has a free end being not aligned with the axis of the end portion of the stem.

181. The brush of claim 180, wherein the brush comprises at least three side faces having shapes differing from one another.

182. The brush of claim 180, wherein, when the core is straightened, the bristles define a notch defining a maximum width between ends of the notch.

183. The brush of claim 180, wherein, when the core is straightened, the bristles define a notch, the notch being concave in a direction substantially perpendicular to the core.

184. The brush of claim 182, wherein the notch is partially cylindrical about an axis perpendicular to the axis of the core when the core is straightened.

185. The brush of claim 182, wherein the notch is concave.

186. The brush of claim 182, wherein, when the core is straightened, the bristles define an odd number of notches.

187. The brush of claim 186, wherein the number of notches is one of three, five, and seven.

188. The brush of claim 180, wherein, when the core is straightened, the bristles define at least four side faces, two of the four side faces being substantially planar and two of the four side faces not being substantially planar, wherein the two substantially planar side faces are adjacent to one another and the two side faces that are not substantially planar are adjacent to one another.

189. The brush of claim 180, wherein the bristles define at least one cross-section that is substantially rectangular, and wherein, when the core is straightened, the bristles define two adjacent substantially planar faces and two adjacent concave faces.

190. The brush of claim 180, wherein, when the core is straightened, the bristles define a general peanut shape having at least one flat side.

191. The brush of claim 180, wherein, when the core is straightened, the bristles define a general peanut shape having at least three substantially planar facets defining a substantially triangular shaped cross-section along a portion of the length of the brush.

192. The brush of claim 180, wherein the brush is made from a blank having a general shape chosen from a substantially bullet shape, a substantially peanut shape, a substantially buoy shape, a substantially fish shape, a substantially hourglass shape, and a substantially football shape.

193. The brush of claim 192, wherein the bristles define a cross-section having at least one of a maximum cross-sectional area and a minimum cross-sectional area located between two axial ends of the brush.

194. The brush of claim 180, wherein the core is located off-center in the cross-section of the brush over at least a portion of the length of the brush.

195. The brush of claim 180, wherein the core comprises a twisted wire core having one of a left-hand pitch and a right-hand pitch.

196. The brush of claim 195, wherein the core has a left-hand pitch and is curved in a manner so as to decrease inclination of helical sheets formed by ends of the bristles relative to the axis of the stem in a direction facing away from the stem.

197. The brush of claim 180, wherein the bristles have differing lengths.

198. The brush of claim 197, wherein longer bristles define an envelope surface defining a volume containing shorter bristles.

199. The brush of claim 180, wherein the cross-section includes peripheral steps over at least a portion of the length of the core.

200. The brush of claim 180, wherein the core passes through the center of the cross-section of the brush at at least one location along the length of the core and the core passes through a point other than the center of the cross-section of the brush at at least one location along the length of the core.

201. The brush of claim 200, wherein the at least one location along the length of the core where the core passes through the center of the cross-section of the brush is located adjacent the stem.

202. The brush of claim 200, wherein the at least one location along the length of the core where the core passes through the center of the cross-section of the brush is located at a free end of the core.

203. A system comprising:

the brush of claim 180; and a reservoir configured to contain a product to be applied by the brush.

204. The system of claim 203, further comprising product contained in the reservoir, wherein the product is a hair product.

205. The system of claim 204, wherein the product is mascara.

206. The system of claim 203, further comprising a wiper associated with the reservoir.

207. The system of claim 203, wherein the brush comprises a cap configured to close the reservoir.

208. A method of applying product to keratinous fibers, comprising:

providing the brush of claim 180;

loading the brush with product; and applying the product to keratinous fibers with the brush.

209. The method of claim 208, wherein the keratinous fibers are eyelashes.

210. A brush comprising:

a core curved along at least a portion of its length so that an axis of the core defines a curve in a plane of curvature; and a plurality of bristles connected to the core, the bristles defining a cross-section of the brush that varies over at least a portion of the length of the core in a manner that is not geometrically similar, wherein the cross-section of the brush at at least one position along the length of the core is substantially asymmetric in relation to a plane perpendicular to the plane of curvature, and wherein along at least a portion of the length of the brush, the cross-section of the brush has a varying width dimension, the width dimension passing through the core and being perpendicular to the plane of curvature.

211. The brush of claim 210, wherein the brush comprises at least three side faces having shapes differing from one another.

212. The brush of claim 210, wherein, when the core is straightened, the bristles define a notch defining a maximum width between ends of the notch.

213. The brush of claim 210, wherein, when the core is straightened, the bristles define a notch, the notch being concave in a direction substantially perpendicular to the core.

214. The brush of claim 212, wherein the notch is partially cylindrical about an axis perpendicular to the axis of the core when the core is straightened.

215. The brush of claim 212, wherein the notch is concave.

216. The brush of claim 212, wherein, when the core is straightened, the bristles define an odd number of notches.

217. The brush of claim 216, wherein the number of notches is one of three, five, and seven.

218. The brush of claim 210, wherein, when the core is straightened, the bristles define at least four side faces, two of the four side faces being substantially planar and two of the four side faces not being substantially planar, wherein the two substantially planar side faces are adjacent to one another and the two side faces that are not substantially planar are adjacent to one another.

219. The brush of claim 210, wherein the bristles define at least one cross-section that is substantially rectangular, and wherein, when the core is straightened, the bristles define two adjacent substantially planar faces and two adjacent concave faces.

220. The brush of claim 210, wherein, when the core is straightened, the bristles define a general peanut shape having at least one flat side.

221. The brush of claim 210, wherein, when the core is straightened, the bristles define a general peanut shape having at least three substantially planar facets defining a substantially triangular shaped cross-section along a portion of the length of the brush.

222. The brush of claim 210, wherein the brush is made from a blank having a general shape chosen from a substantially bullet shape, a substantially peanut shape, a substantially buoy shape, a substantially fish shape, a substantially hourglass shape, and a substantially football shape.

223. The brush of claim 222, wherein the bristles define a cross-section having at least one of a maximum cross-sectional area and a minimum cross-sectional area located between two axial ends of the brush.

224. The brush of claim 210, wherein the core is located off-center in the cross-section of the brush over at least a portion of the length of the brush.

225. The brush of claim 210, wherein the core comprises a twisted wire core having one of a left-hand pitch and a right-hand pitch.

226. The brush of claim 225, further comprising a stem connected to the core and having an axis, the stem being located at one end of the core, the core having a left-hand pitch and being curved in a manner so as to decrease inclination of helical sheets formed by ends of the bristles relative to the axis of the stem in a direction facing away from the stem.

227. The brush of claim 210, wherein the bristles have differing lengths.

228. The brush of claim 227, wherein longer bristles define an envelope surface defining a volume containing shorter bristles.

229. The brush of claim 210, wherein the cross-section includes peripheral steps over at least a portion of the length of the core.

230. The brush of claim 210, wherein the core passes through the center of the cross-section of the brush at at least one location along the length of the core and the core passes through a point other than the center of the cross-section of the brush at at least one location along the length of the core.

231. The brush of claim 230, further comprising a stem connected to the core, wherein the at least one location along the length of the core where the core passes through the center of the cross-section of the brush is located adjacent the stem.

232. The brush of claim 230, wherein the at least one location along the length of the core where the core passes through the center of the cross-section of the brush is located at a free end of the core.

233. A system comprising:

the brush of claim 210; and a reservoir configured to contain a product to be applied by the brush.

234. The system of claim 233, further comprising product contained in the reservoir, wherein the product is a hair product.

235. The system of claim 234, wherein the product is mascara.

236. The system of claim 233, further comprising a wiper associated with the reservoir.

237. The system of claim 233, wherein the brush comprises a cap configured to close the reservoir.

238. A method of applying product to keratinous fibers, comprising:

providing the brush of claim 210;

loading the brush with product; and applying the product to keratinous fibers with the brush.

239. The method of claim 238, wherein the keratinous fibers are eyelashes.

240. A method of manufacturing a brush, comprising:

providing a blank comprising a core, a plurality of bristles connected to the core, the bristles defining a cross-section of the blank that varies over at least a portion of the length of the core in a manner that is not geometrically similar, and at least one face having a non-planar shape; and curving the core along at least a portion of its length so that an axis of the core defines a curve in a plane of curvature, wherein the curving causes the at least one face to become substantially planar shaped, and wherein the blank is transformed into a brush and the cross-section of the brush at at least one position along the length of the core is substantially asymmetric in relation to a plane perpendicular to the plane of curvature.

241. The method of claim 240, wherein the blank comprises at least one additional face having a substantially planar shape.

242. The method of claim 241, wherein the curving causes the at least one additional face to become non-planar.

243. The method of claim 242, wherein the curving causes the at least one additional face to become substantially convex shaped.

244. The method of claim 242, wherein the curving causes the at least one additional face to become substantially concave shaped.

245. The method of claim 242, wherein the at least one face of the blank has a substantially concave shape.

246. The method of claim 240, wherein the at least one face of the blank has a substantially convex shape.

247. The method of claim 240, wherein the curving comprises curving the core in a plane of curvature perpendicular to the at least one face of the blank.

248. The method of claim 240, wherein the blank further comprises at least one additional face having a substantially concave shape, wherein the curving causes the at least one additional face to become substantially convex shaped.

249. The method of claim 240, wherein the blank further comprises at least one additional face having a substantially convex shape, wherein the curving causes the at least one additional face to become substantially concave shaped.

250. The method of claim 240, wherein the plane of curvature defines a plane of symmetry for the at least one face.

251. The method of claim 240, wherein the bristles of the blank comprise ends defining an envelope surface having a general shape chosen from a substantially cylindrical shape having a substantially circular cross-section, a substantially peanut shape, a substantially buoy shape, and a substantially fish shape.

252. The method of claim 240, wherein the core is a twisted wire core having a left-hand pitch.

253. The method of claim 240, wherein the brush is configured so that the core passes through the center of the cross-section of the brush at at least one location along the length of the core.

254. The method of claim 240, wherein the curve has a convex side and a concave side, wherein the bristles comprise ends defining an envelope surface, and wherein, in the plane of curvature, the distance from the convex side of the curve to the envelope surface varies along at least a portion of the length of the core.

255. The method of claim 240, wherein the bristles of the blank comprise bristle ends defining at least one notch having a maximum width located between ends of the notch spaced apart from one another along the length of the blank.

256. The method of claim 240, wherein the bristles of the blank comprise bristle ends defining at least one notch, the notch being concave in at least one plane intersecting the notch.

257. The method of claim 240, wherein the curve has a convex side and a concave side, wherein the bristles comprise ends defining an envelope surface, and wherein the envelope surface on the convex side of the curve defines a substantially planar surface along at least a portion of the length of the brush, the substantially planar surface intersecting the plane of curvature.

258. The method of claim 240, wherein the curve has a convex side and a concave side, wherein the bristles comprise ends defining an envelope surface, and wherein, in the plane of curvature, the envelope surface on the convex side of the curve defines a substantially rectilinear edge along at least a portion of the length of the brush.

259. The method of claim 240, wherein the brush comprises a stem having an end portion connected to the core, the end portion of the stem defining an axis, and wherein the brush has a free end being not aligned with the axis of the end portion of the stem.

260. The method of claim 240, wherein the brush is configured so that along at least a portion of the length of the brush, the cross-section of the brush has a varying width dimension, the width dimension passing through the core and being perpendicular to the plane of curvature.

261. The method of claim 240, wherein the core of the blank is substantially rectilinear.

262. The method of claim 240, wherein the blank comprises a stem connected to the core.

263. The method of claim 240, further comprising connecting a stem to the core.

264. A brush manufactured according to the method of claim 240.

265. The method of claim 240, wherein the blank comprises at least one edge having a substantially rectilinear shape, and wherein the curving causes the at least one edge to become non-rectilinear shaped.

266. The method of claim 265, wherein the curving causes the at least one edge to become convex shaped.

267. The method of claim 265, wherein the curving causes the at least one edge to become concave shaped.

268. The method of claim 240, wherein the blank comprises at least one non-rectilinear edge, and wherein the curving causes the at least one non-rectilinear edge to become substantially rectilinear.

269. The method of claim 268, wherein the at least one non-rectilinear edge of the blank has a concave shape.

270. The method of claim 268, wherein the at least one non-rectilinear edge of the blank has a convex shape.

271. The method of claim 240, wherein the at least one face extends partially along the length of the core.

272. A method of manufacturing a brush, comprising:

providing a blank comprising a core, a plurality of bristles connected to the core, the bristles defining a cross-section of the blank that varies over at least a portion of the length of the core in a manner that is not geometrically similar, and at least one edge having a non-rectilinear shape; and curving the core along at least a portion of its length so that an axis of the core defines a curve in a plane of curvature, wherein the curving causes the at least one edge to become substantially rectilinear shaped, and wherein the blank is transformed into a brush and the cross-section of the brush at at least one position along the length of the core is substantially asymmetric in relation to a plane perpendicular to the plane of curvature.

273. The method of claim 272, wherein the plane of curvature contains the at least one edge.

274. The method of claim 272, wherein the blank comprises at least one face having a substantially planar shape.

275. The method of claim 274, wherein the curving causes the at least one face to become non-planar.

276. The method of claim 275, wherein the curving causes the at least one face to become substantially convex shaped.

277. The method of claim 275, wherein the curving causes the at least one face to become substantially concave shaped.

278. The method of claim 272, wherein the blank further comprises at least one additional edge having a substantially concave shape, wherein the curving causes the at least one additional edge to become substantially convex shaped.

279. The method of claim 272, wherein the blank further comprises at least one additional edge having a substantially convex shape, wherein the curving causes the at least one additional edge to become substantially concave shaped.

280. The method of claim 272, wherein the bristles of the blank comprise ends defining an envelope surface having a general shape chosen from a substantially cylindrical shape having a substantially circular cross-section, a substantially peanut shape, a substantially buoy shape, and a substantially fish shape.

281. The method of claim 272, wherein the core is a twisted wire core having a left-hand pitch.

282. The method of claim 272, wherein the brush is configured so that the core passes through the center of the cross-section of the brush at at least one location along the length of the core.

283. The method of claim 272, wherein the curve has a convex side and a concave side, wherein the bristles comprise ends defining an envelope surface, and wherein, in the plane of curvature, the distance from the convex side of the curve to the envelope surface varies along at least a portion of the length of the core.

284. The method of claim 272, wherein the bristles of the blank comprise bristle ends defining at least one notch having a maximum width located between ends of the notch spaced apart from one another along the length of the blank.

285. The method of claim 272, wherein the bristles of the blank comprise bristle ends defining at least one notch, the notch being concave in at least one plane intersecting the notch.

286. The method of claim 272, wherein the curve has a convex side and a concave side, wherein the bristles comprise ends defining an envelope surface, and wherein the envelope surface on the convex side of the curve defines a substantially planar surface along at least a portion of the length of the brush, the substantially planar surface intersecting the plane of curvature.

287. The method of claim 272, wherein the curve has a convex side and a concave side, wherein the bristles comprise ends defining an envelope surface, and wherein, in the plane of curvature, the envelope surface on the convex side of the curve defines a substantially rectilinear edge along at least a portion of the length of the brush.

288. The method of claim 272, wherein the brush comprises a stem having an end portion connected to the core, the end portion of the stem defining an axis, and wherein the brush has a free end being not aligned with the axis of the end portion of the stem.

289. The method of claim 272, wherein the brush is configured so that along at least a portion of the length of the brush, the cross-section of the brush has a varying width dimension, the width dimension passing through the core and being perpendicular to the plane of curvature.

290. The method of claim 272, wherein the core of the blank is substantially rectilinear.

291. The method of claim 272, wherein the blank comprises a stem connected to the core.

292. The method of claim 272, further comprising connecting a stem to the core.

293. A brush manufactured according to the method of claim 272.

294. The method of claim 272, wherein the blank comprises at least one additional edge having a substantially rectilinear shape, and wherein the curving causes the at least one edge to become non-rectilinear shaped.

295. The method of claim 294, wherein the curving causes the at least one additional edge to become convex shaped.

296. The method of claim 294, wherein the curving causes the at least one additional edge to become concave shaped.

297. The method of claim 272, wherein the at least one edge extends partially along the length of the core.

* * * * *

UNITED STATES PATENT AND TRADEMARK OFFICE

CERTIFICATE OF CORRECTION

PATENT NO. : 7,171,969 B2
APPLICATION NO. : 10/084939
DATED : February 6, 2007
INVENTOR(S) : Jean-Louis H. Gueret It is certified that error appears in the above-identified patent and that said Letters Patent is hereby corrected as shown below:

In claim 245, column 30, line 32, “claim 242” should read --claim 240--.

Signed and Sealed this

Tenth Day of April, 2007

JON W. DUDAS
*Director of the United States Patent and Trademark Office*